1/25/77 OR 4,005,028

United States Patent [19]

Heckert et al.

[11] 4,005,028

[45] Jan. 25, 1977

[54] ORGANOSILANE-CONTAINING DETERGENT COMPOSITION

[75] Inventors: David C. Heckert, Oxford; David M. Watt, Jr., Cincinnati, both of Ohio

[73] Assignee: The Procter & Gamble Company, Cincinnati, Ohio

[22] Filed: Apr. 22, 1975

[21] Appl. No.: 570,534

[52] U.S. Cl. ..... 252/99; 252/94; 252/DIG. 15; 260/448.8 R; 260/448.2 N

[51] Int. Cl.[2] ..... C11D 7/56

[58] Field of Search ..... 260/448.8 R, 448.2 N, 260/448.2 E, 448.2 Q; 252/99, DIG. 15, 94

[56] References Cited

UNITED STATES PATENTS

| | | | |
|---|---|---|---|
| 2,955,127 | 10/1960 | Pike | 260/448.2 Q |
| 3,389,160 | 6/1968 | Reid | 260/448.2 N |
| 3,557,178 | 1/1971 | Golitz | 260/448.2 N |
| 3,624,120 | 11/1971 | Yetter | 260/448.2 E |
| 3,658,867 | 4/1972 | Prokai | 260/448.2 N |

FOREIGN PATENTS OR APPLICATIONS

| | | | |
|---|---|---|---|
| 882,053 | 10/1957 | United Kingdom | 260/448.2 N |
| 686,068 | 4/1959 | United Kingdom | 260/448.2 N |

*Primary Examiner*—Mayer Weinblatt
*Attorney, Agent, or Firm*—C. R. Wilson; R. B. Aylor; T. H. O'Flaherty

[57] ABSTRACT

A detergent composition containing an organosilane is capable of imparting soil release benefits to hard surfaces washed therewith. Soil adheres to such surfaces less strongly thereby making them easier to clean. The detergent composition can be formulated for use in a wide range of applications, e.g., as a light duty liquid composition, rinse aid, oven cleaner, window cleaner, automatic dishwasher composition, car wash detergent composition or toilet bowl cleaner.

45 Claims, No Drawings

ORGANOSILANE-CONTAINING DETERGENT COMPOSITION

BACKGROUND OF THE INVENTION

This invention relates to a detergent composition containing an organosilane compound. The detergent compositions of this invention are intended for use on hard, i.e. metallic and vitreous surfaces. More particularly, the inclusion of the hereindescribed organosilane compound in detergent compositions provides soil release benefits to surfaces washed with such compositions.

Detergent compositions intended for use on hard surfaces are continually being reformulated in order to improve their performance. Generally, detergent compositions are formulated to obtain optimum cleaning performance. Such endeavors have revolved around the use of different organic detergents as well as the use of detergent builders and various additives, e.g., enzymes, bleaches and pH modifiers. Considerations such as human safety, compatibility of components, and equipment safety have played a part in dictating what components can be used for improving existing detergent compositions.

Other attempts at insuring that hard surfaces are clean have involved the application of various surface coatings to such hard surfaces. For example, cookware which has been coated with Teflon provides a surface which is easier to clean. Thus, while soil continues to deposit upon the surface, its removal is easier by virtue of the coating. Unfortunately, such coatings are relatively expensive. Moreover, such a coating on glassware would be objectionable due to its appearance and/or feel. Since this kind of a coating must be applied by the manufacturer of the cookware or glassware, it must be permanent; this generally involves a relatively heavy coating with the consequent drawback in terms of cost, appearance, and/or feel.

It has been discovered that a very thin layer of a compound possessing soil release benefits can be supplied to metallic and vitreous surfaces by a detergent composition. Thus, when the detergent composition is used for cleaning or washing the hard surface, a thin semi-permanent coating of the compound is deposited. The amount of coating is sufficient to provide a soil release benefit to the surface, while at the same time, is not visible or expensive.

It accordingly is an object of this invention to provide detergent compositions which are capable of imparting a soil release benefit to surfaces contacted therewith.

It is another object of this invention to provide detergent compositions containing an organosilane which are able to efficiently provide soil release benefits to metallic and vitreous surfaces when applied thereto form a dilute wash or rinse solution.

Still another object of this invention is to provide a method for imparting a soil release benefit to hard surfaces.

As used herein, all percentages and ratios are by weight unless otherwise indicated.

SUMMARY OF THE INVENTION

A detergent composition capable of imparting soil release benefits to metallic and vitreous surfaces contacted therewith consisting essentially of:

a. an organosilane having the formula $$(R_1O)_{3-a}-\overset{(R_2)_a}{\overset{|}{Si}}-(CHR_3)_b-\left[O-CH_2-CHOH-CH_2\right]_c$$

$$-\overset{R_4}{\underset{R_4}{\overset{|}{\underset{|}{Y^+}}}}-R_5\ X^-$$

or is siloxane oligomer thereof wherein $R_1$ is an alkyl group containing 1 to 4 carbon atoms, $$(CH_3)_3Si \text{ or } Z(OC_xH_{2x})_m$$

where $x$ is 2 to 4, $m$ is 1 to 20, and Z is hydrogen, an alkyl group containing 1 to 18 carbons or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen; $R_5$ is an alkyl, aryl or arylalkyl group containing 1 to 22 carbon atoms; X is halide; and Y is nitrogen, sulfur or phosphorus; and b. a water-soluble organic detergent selected from the group consisting of nonionic, zwitterionic and ampholytic detergents and mixtures thereof in a weight ratio of organosilane to detergent of from 2:1 to 1:10,000.

DESCRIPTION OF THE INVENTION

The subject invention relates to all manner of detergent compositions. As examples, may be mentioned the following: automatic dishwasher detergent compositions intended for home use, commercial dishwasher detergent compositions, light duty liquid detergent compositions, car wash detergent compositions, rinse aids, window cleaners, toilet bowl cleaners and oven cleaners. The previous listing is merely illustrative and is in no way limiting. Such compositions are further described hereinafter. The compositions may be used on any metallic or vitreous surface where a soil release benefit is desired. Examples of such surfaces are cooking utensils (e.g., metallic pots, pans and skillets), tableware (e.g., china, glasses, ceramic ware, and flatware), oven walls, automobiles, windows, and porcelain surfaces (e.g., bathtubs, sinks and toilet bowls).

The detergent compositions of this invention contain an organosilane and a water-soluble organic nonionic, zwitterionic and/or ampholytic detergent in a ratio of organosilane to detergent of from 2:1 to 1:10,000, preferably 1:1 to 1:500, most preferably 1:3 to 1:60. The organosilane has the following formula:

$$(R_1O)_{3-a}-\overset{(R_2)_a}{\overset{|}{Si}}-(CHR_3)_b-\left[O-CH_2-CHOH-CH_2\right]_c$$

-continued

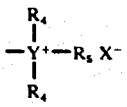

or is a siloxane oligomer thereof wherein $R_1$ is an alkyl group containing 1 to 4 carbon atoms, $(CH_3)_3Si$ or $Z(OC_xH_{2x})_m$ where $x$ is 2 to 4, $m$ is 1 to 20, and Z is hydrogen, an alkyl group containing 1 to 18 carbon atoms or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where $x$, $m$ and Z are as defined above, or oxygen provided only one $R_4$ is oxygen; $R_5$ is an alkyl, aryl or arylalkyl group containing 1 to 22 carbon atoms; X is halide; and Y is nitrogen, sulfur or phosphorus. Preferably X is chloride or bromide and $b$ is 1.

It should be understood that the $R_4$ in the above formula and the formulae to follow may be the same or different. It should further be understood that when Y is S, there will be only one $R_4$ substituent. Also, when one $R_4$ is oxygen or, under acidic conditions, the anion of a carboxylic acid substituted alkyl, the counter ion $X^-$ is not extant. The 1 to 4 carbon atoms in the carboxy-substituted alkyl group is inclusive of the carboxyl group. The aryl or arylalkyl groups of $R_4$ and $R_5$ contain 6 to 12 carbon atoms and 6 to 22 carbon atoms, respectively.

Classes of organosilane compounds and their preparation which fit the above description follow.

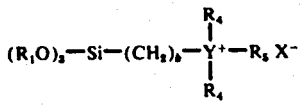

I.

wherein $R_1$ is a $C_{1-4}$ alkyl group, $b$ is from 1–3, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{4-22}$ alkyl, aryl or arylalkyl group, X is a halide, and Y is N, S or P.

When $b$ is 3 and $R_4$ is a $C_{1-12}$ alkyl, aryl or arylalkyl group, the class of compounds represented by Formula I is prepared by the following route:

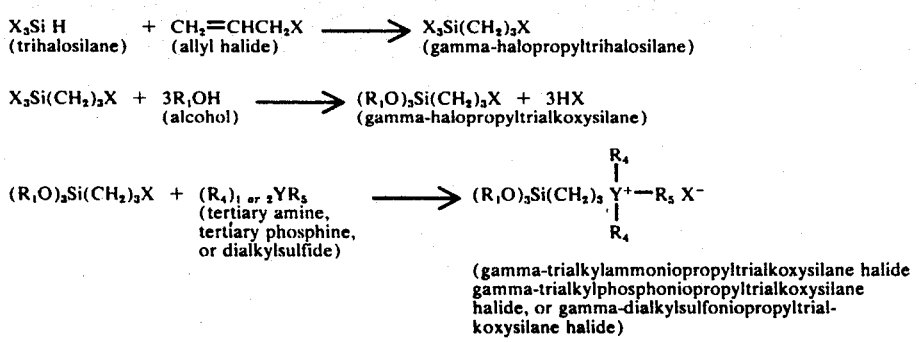

The trihalosilane (where the halogen is chlorine or bromine) is reacted with the allyl chloride at about 100° C. for from 4 to 10 hours in the presence of a catalyst, e.g., chloroplatinic acid or platinum. The resultant gamma-halopropyltrihalosilane is reacted with a lower alcohol to produce the gamma-halopropyltrialkoxysilane. At least three equivalents of alcohol per equivalent of halopropyltrihalosilane are added slowly to the silane. The gamma-halopropyltrihalosilane may be dissolved in an inert solvent, preferably hexane or pentane. (See W. Noll, "Chemistry and Technology of Silanes," Academic Press, New York, 1968, page 81 for the alcoholysis of halosilanes.) One equivalent of the gamma-halopropyltrialkoxysilane is reacted with one equivalent of the tertiary amine, tertiary phosphine, or dialkylsulfide to produce the organosilane. An inert solvent, preferably of high dielectric constant, may be used. The reaction is carried out at temperatures of from 40° C. to 120° C. and a time of 2 to 10 hours for the reaction of the bromopropyltrialkoxysilane and 120° C. to 150° C. for 2 to 20 hours for the reaction of the chloropropyltrialkoxysilane.

The compounds of Formula I when at least one $R_4$ is a carboxy-substituted $C_{1-4}$ alkyl group are prepared in the same manner except for the last reaction step. Here, a tertiary amine, tertiary phosphine or dialkylsulfide having a carboxy-containing alkyl group(s) is reacted with the alpha, beta or gamma-haloalkyltrialkoxysilane at 50° C. to 200° C. for 2 hours to 20 hours. Such carboxy-substituted tertiary amines, tertiary phosphines, and dialkylsulfides are produced by reacting $R_4YHR_5$ or $HYR_5$ (where Y is sulfur)

with $X(CH_2)_{1-4}COOH$ in the presence of base at elevated temperatures, e.g. 50° C. to 150° C.

The compounds of Formula I when at least one $R_4$ is $(C_xH_{2x}O)_mZ$ with X, *m* and Z as defined above are produced in the manner given above except for the last reaction step. Thus, alpha- beta- and gamma-haloalkyltrialkoxysilane is reacted with a tertiary amine, tertiary phosphine, or dialkylsulfide where at least one substituent is $$(C_xH_{2x}O)_mZ$$

The reaction takes place at a temperature of 50° C. to 200° C. and a time of from 2 to 10 hours.

Compounds of Formula I when one $R_4$ is oxygen are prepared by following the reactions outlined above up to the last reaction step. At this point, a dialkyl amine, dialkyl phosphine or alkylthiol is reacted with the halosilane at 50° C. to 200° C. for from 4 to 10 hours and then with base to produce an intermediate tertiary amine, phosphine, or dialkyl sulfide. These intermediates are then reacted with $H_2O_2$ at 20° C. to 100° C. or preferably $O_3$ in an inert solvent at −80° C. to 20° C. to yield the organosilane.

When *b* is 2 in Formula I, a trihalovinylsilane of formula $$X_3SiCH{=}CH_2$$

(which is commercially available) is reacted with hydrogen bromide in the presence of peroxide or light to produce a beta-haloethyltrihalosilane. This compound is reacted with an alcohol and thereafter with an appropriate amine, phosphine, or sulfide in the manner discussed above for the preparation of the compounds of Formula I when *b* is 3.

When *b* is 1 in Formula I, the starting reactant is a commercially available trihalomethylsilane of formula $$X_3SiCH_3.$$

This silane is reacted with chlorine or, preferably a half mole of bromine and a half mole of chlorine in the presence of light (such as provided by an ordinary tungsten or fluorescent lamp). The resultant alpha-halomethyltrihalosilane is reacted with an alcohol and thereafter an appropriate amine, phosphine or sulfide in the manner discussed above with the compounds of Formula I when *b* is 3.

Examples of compounds illustrative of compounds of Formula I follow:

$(CH_3O)_3SiCH_2N^+(CH_3)_2C_{16}H_{33}$ $Cl^-$
$(CH_2H_5O)_3SiCH_2N^+(CH_3)_2C_6H_5$ $Cl^-$
$(C_2H_5O)_3Si(CH_2)_3N^+(C_2H_5)_2C_{10}H_{21}$ $Br^-$
$(C_3H_7O)_3SiCH_2N^+(C_3H_7)_2C_6H_4CH_3$ $Br^-$
$(C_4H_9O)_3Si(CH_2)_2N^+(C_2H_5)(CH_2C_6H_5)_2$ $Cl^-$
$(CH_3O)_3SiCH_2P^+(C_2H_5)_2C_{12}H_{25}$ $Cl^-$
$(C_2H_5O)_3Si(CH_2)_3P^+(C_4H_9)_2C_6H_5$ $Cl^-$
$(C_3H_7O)_3Si(CH_2)_2S^+(CH_3)C_6H_5$ $Cl^-$
$(CH_3O)_3SiCH_2CH_2S^+(C_2H_5)C_{16}H_{33}$ $Br^-$
$(CH_3O)_3SiCH_2N^+(C_2H_4COOH)_2C_{10}H_{21}$ $Br^-$
$(C_2H_5O)_3Si(CH_2)_3N^+(CH_2COOH)(CH_3)C_{12}H_{25}$ $Cl^-$
$(C_2H_5O)_3Si(CH_2)_2P^+(C_3H_6COOH)C_2H_5)C_{10}H_{21}$ $Cl^-$
$(C_4H_9O)_3SiCH_2S^+(C_3H_6COOH)C_6H_{13}$ $Br^-$
$(CH_3O)_3SiCH_2N^+(C_2H_4OH)_2C_{18}H_{37}$ $Cl^-$
$(C_4H_9O)_3Si(CH_2)_3P^+(C_3H_6OH)_2C_6H_4CH_3$ $Cl^-$
$(C_2H_5O)_3SiCH_2S^+(C_3H_6OH)C_{14}H_{29}$ $Cl^-$
$(CH_3O)_3SiCH_2N^+(O)^-(CH_3)C_{14}H_{29}$
$(C_2H_5O)_3Si(CH_2)_3P^+(O)^-(C_2H_5)C_{12}H_{25}$
$(C_2H_5O)_3si(CH_2)_2S^+(O)^-C_{10}H_{21}$
$(CH_3O)_3SiCH_2N^+[(C_2H_4O)_3H](CH_3)C_8H_{17}$ $Cl^-$
$(CH_3O)_3Si(CH_2)_2N^+[(C_4H_8O)_{15}CH_3](CH_3)C_6H_{13}$
$(C_2H_5O)_3Si(CH_2)_3N^+[(C_2H_4O)_6H]_2C_{10}H_{21}$ $Cl^-$
$(CH_3O)_3SiCH_2N^+[(C_2H_4O)_3COCH_3]_2C_8H_{17}$ $Cl^-$
$(C_3H_7O)_3SiCH_2P^+[(C_3H_6O)_{12}H]_2CH_2C_6H_5$ $Cl^-$
$(C_4H_9O)_3Si(CH_2)_3P^+[(C_2H_4O)_4C_4H_9]$ $CH_3C_4H_9$ $Br^-$
$(CH_3O)_3Si(CH_2)_2P^+[(C_2H_4O)_5COC_2H_5]_2C_4H_9$ $Br^-$
$(CH_3O)_3SiCH_2S^+[(C_2H_4O)_5H]C_{10}H_{21}$ $Cl^-$
$(C_2H_5O)_3Si(CH_2)_2S^+[(C_3H_6O)_8C_3H_7]C_4H_9$ $Br^-$
$(CH_3O)_3Si(CH_2)_3S^+[(C_2H_4O)_{12}COC_4H_9]C_{12}H_{25}$ $Cl^-$

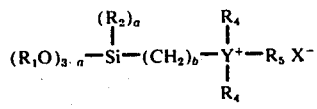

II.

where $R_1$ is a $C_{1-4}$ alkyl group, $R_2$ is a $C_{1-18}$ alkyl group *a* is 1 or 2, *b* is 1-3, $R_4$ is a $C_{1-12}$ alkyl, aryl or arylalkyl group, a carboxy-substituted $C_{1-4}$ alkyl group, $$(C_xH_{2x}O)_mZ$$

where *x* is 2-4, *m* is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

The compounds of Formula II are prepared in a manner similar to the preparation of the compounds of Formula I except for the fact that the starting reactants (when *b* is 1, 2, or 3) all have a $C_{1-18}$ alkyl group or two $C_{1-18}$ alkyl groups attached to the Si atom in place of a halogen atom(s). The starting reactant is commercially available when $R_2$ is $CH_3$. When $R_2$ is $C_2H_5$ or greater, the compound is prepared by reacting a silane with an appropriate olefin. Thus, $$X_{3-a}SiH_{1+a}$$

is reacted with a $C_2$ to $C_{18}$ olefin to obtain the desired starting reactant. The remaining reaction steps and conditions for producing the desired organosilane of Formula II are essentially the same as for producing the compounds of Formula I.

Examples of compounds of Formula II are:

$(CH_3O)_2CH_3SiCH_2N^+(CH_3)_2C_{12}H_{25}$ $Cl^-$
$(C_2H_5O)_2C_6H_{13}Si(CH_2)_2N^+(CH_3)_2C_{18}H_{37}$ $Cl^-$
$(C_3H_7O)(C_3H_7)_2Si(CH_2)_3N^+(C_2H_5)_2C_{10}H_{21}$ $Cl^-$
$(CH_3O)(CH_3)_2SiCH_2P^+(CH_3)_2C_{10}H_{21}$ $Cl^-$
$(C_3H_7O)_2C_{10}H_{21}Si(CH_2)_2S^+(C_4H_9)C_6H_{12}C_6H_5$ $Cl^-$
$(CH_3O)_2C_{16}H_{33}Si(CH_2)_3N^+(C_2H_4COOH)(CH_3)C_4H_9$ $Cl^-$
$(C_2H_5O)(CH_3)_2Si(CH_2)_2P^+(CH_2COOH)_2C_{10}H_{21}$ $Cl^-$
$(C_3H_7O)_2CH_3SiCH_2S^+(C_3H_6COOH)C_6H_{13}$ $Cl^-$
$(CH_3O)_2CH_3SiCH_2N^+(C_2H_4OH)_2C_{18}H_{37}$ $Cl^-$
$(C_3H_7O)(CH_3)_2SiCH_2P^+(C_3H_6OH)(C_4H_9)_2$ $Br^-$
$(C_4H_9O)_2CH_3Si(CH_2)_3S^+(C_3H_6OH)CH_3$ $Br^-$
$(CH_3O)_2CH_3SiCH_2N^+(O)^-(CH_3)C_{16}H_{33}$
$(CH_3O)_2C_{14}H_{29}Si(CH_2)_2P^+(O)^-(C_4H_9)_2$
$(C_4H_9O)(CH_3)_2Si(CH_2)_3S^+(O)^-C_{14}H_{29}$
$(CH_3O)_2CH_3SiCH_2N^+[(C_3H_6O)_{20}H]_2C_6H_5$ $Cl^-$
$(CH_3O)_2C_2H_5Si(CH_2)_2N^+[(C_4H_8O)_6C_2H_5]_2CH_3$ $Cl^-$
$(C_2H_5O)(CH_3)_2SiCH_2P^+[(C_2H_4O)_2H](C_6H_5)_2$ $Cl^-$
$(C_2H_5O)_2C_8H_{17}Si(CH_2)_3P^+[(C_2H_4O)_4C_6H_{13}]_2C_4H_9$ $Cl^-$
$(CH_3O)_2CH_3SiCH_2P^+[(C_2H_4O)_6COCH_3]_2C_8H_{17}$ $Cl^-$
$(CH_3O)_2CH_3SiCH_2S^+[(C_3H_6O)_2H]C_{14}H_{29}$ $Cl^-$
$(C_2H_5O)(C_2H_5)_2Si(CH_2)_3S^+[(C_2H_4O)_5CH_3]C_8H_{17}$ $Br^-$
$(C_2H_5O)_2C_{10}H_{21}SiCH_2N^+[(C_2H_4O)_2COC_2H_5](C_4H_9)_2$ $Cl^-$ $(CH_3O)_2C_4H_9Si(CH_2)_2S^+[(C_2H_4O)_2COCH_3]C_{12}H_{25}$ $Br^-$.

Compounds of Formulas I and II when $R_4$ is an alkyl, aryl, arylalkyl group or oxygen are disclosed in British Pat. Nos. 686,068 and 882,053 and U.S. Pat. Nos. 2,955,127, 3,557,178, 3,730,701, and 3,817,739. Compounds of Formulas I and II when $R_4$ is a carboxy-substituted alkyl group or $(C_xH_{2x}O)_mZ$ are disclosed in commonly assigned copending patent application "Organosilane Compounds" by Heckert and Watt U.S. Ser. No. 570,532, filed Apr. 22, 1975. (The disclosure of this application is herein incorporated by reference.)

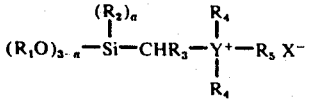

III.

wherein $R_1$ is $C_{1-4}$ alkyl group, $a$ is 0 to 2, $R_2$ is a $C_{1-18}$ alkyl group, $R_3$ is a $C_{1-18}$ alkyl group, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

The compounds of Formula III when $a$ is 0 and $R_4$ is an alkyl, aryl or arylalkyl group are prepared by the following route:

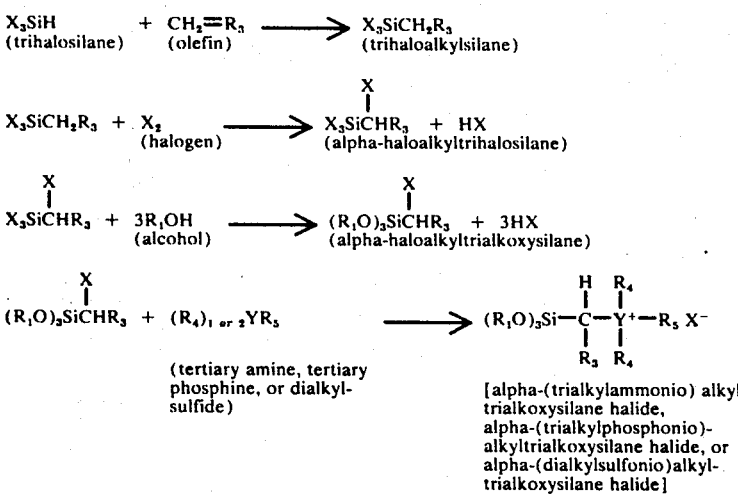

The trihalosilane is reacted with an olefin at 100° C. for 4 to 10 hours under a pressure of 50 to 300 psi. in the presence of a chloroplatinic acid or platinum catalyst to produce the trihaloalkylsilane. This reaction is reported by F. P. Mackay, O. W. Steward and P. G. Campbell in "Journal of the American Chemical Society," 79, 2764 (1957) and J. L. Speier, J. A. Webster and S. W. Barnes in Journal of the American Chemical Society, 79, 974 (1957). The trihaloalkylsilane is then halogenated in a known manner by treating it with halogen in the presence of light (such as that provided by ordinary tungsten or fluorescent lamps). Preferably, halogenation is carried out to only partial completion and a distillation is performed to recycle unreacted alkylsilane. The remaining reactions are the same as those described above in connection with the preparation of the compounds of Formula I.

When $a$ is 1 or 2, the preparation of the compounds is essentially the same except for the use of an alkyl substituted silane as the starting reactant.

When $R_4$ is a carboxy-substituted $C_{1-4}$ alkyl group, oxygen or $(C_xH_{2x}O)_mZ$ where $x$ is 2–4, $m$ is 1–20, and Z is hydrogen, a $C_{1-18}$ alkyl group, or a $C_{1-4}$ acyl group, an appropriate amine, phosphine, or sulfide is used in the reaction step as discussed above for the preparation of similarly substituted compounds of Formula I.

The compounds that follow are illustrative of compounds of Formula III.

$(C_2H_5O)_3SiCH(C_8H_{17})N^+(CH_3)_2C_{12}H_{25}$ $Cl^-$
$(CH_3O)_3SiCH(C_{18}H_{37})N^+(C_2H_4COOH)_2CH_3$ $Cl^-$
$(C_3H_7O)_2CH_3SiCH(C_{12}H_{25})N^+(C_2H_4OH(CH_3)_2$ $Cl^-$
$(C_4H_9O)_3SiCH(C_3H_7)N^+[(C_2H_4O)_{10}H]_2C_6H_{13}$ $Br^-$
$(CH_3O)_3SiCH(C_{10}H_{21})N^+[(C_2H_4O)_2C_4H_9](CH_3)C_6H_5$ $Br^-$
$(CH_3O)_3SiCH(CH_3)N^+[(C_2H_4O)_3COC_2H_5](C_2H_5)_2$ $Br^-$
$(C_2H_5O)_2CH_3SiCH(C_8H_{17})N^+(O)^-(CH_3)_2$
$(CH_3O)_3SiCH(C_8H_{17})P^+CH_3)_3$ $Cl^-$
$(CH_3O)_2CH_3SiCH(CH_3)P^+(C_3H_6COOH)_2C_{14}H_{28}C_6H_5$ $Cl^-$
$(C_2H_5O)_3SiCH(C_{10}H_{21})P^+(C_2H_4OH)C_4H_9$ $Cl^-$
$(CH_3O)_3SiCH(C_3H_7)P^+(O)^-(CH_3)C_{12}H_{25}$
$(CH_3O)_3SiCH(C_8H_{17})P^+[(C_2H_4O)_6H]_2CH_3$ $Cl^-$
$(C_2H_5O)_3SiCH(C_6H_{13})P^+[(C_3H_6O)_2C_{18}H_{37}](CH_32)_2$ $Cl^-$
$(CH_3O)_3SiCH(CH_3)S^+(CH_3)C_{16}H_{33}Br^-$
$(C_2H_5O)_2CH_3SiCH(C_{12}H_{25})S^+(C_2H_4COOH)CH_3Cl^-$
$(CH_3O)_2C_{16}H_{33}SiCH(C_2H_5)S^+(C_2H_4OH)C_2H_5$ $Cl^-$
$(CH_3O)_3SiCH(C_{10}H_{21})S^+(O)^-C_5H_{11}$
$(C_2H_5O)_3SiCH(C_4H_9)S^+[(C_3H_6O)_{10}H]C_6H_5Cl^-$
$(C_2H_5O)_3SiCH(CH_3)S^+[(C_2H_4O)_{20}C_2H_5]CH_3$ $Br^-$

Commonly assigned copending patent application "Organosilane Compounds" by Heckert and Watt U.S. Ser. No. 570,537, filed Apr. 22, 1975 discloses the preparation of these compounds. (The disclosure of this application is herein incorporated by reference).

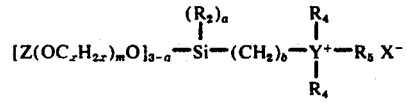

IV.

wherein Z is hydrogen, a $C_{1-18}$ alkyl group or a $C_{1-4}$ acyl group, $x$ is 2–4, $m$ is 1–20, $a$ is 0–2, $R_2$ is a $C_{1-18}$ alkyl group, $b$ is 1–3, $R_4$ is a $C_{1-12}$ alkyl, aryl or arylalkyl group, a carboxy-substituted $C_{1-4}$ alkyl group, $(C_xH_{2x}O)_mZ$ where $x$, $m$ and Z are as defined above, or oxygen provided only one $R_4$ is oxygen, $R_5$ is a $C_{1-22}$ alkyl, aryl or arylalkyl group, X is a halide, and Y is N, S or P.

The compounds with Formula IV are prepared in substantially the same manner as those of Formula II with the exception that $R_1OH$ is $Z(OC_xH_{2x})_mOH$ or alternatively the compounds of Formula II are heated in the presence of $Z(OC_xH_{2x})_mOH$ under conditions such that $R_1OH$ is removed from the system.

Exemplary compounds of Formula IV are as follows:

$[CH_3(OC_2H_4)O]_3SiCH_2N^+(CH_3)_2C_{14}H_{29}$ $Cl^-$ $[CH_3(OC_2H_4)_5O]_2CH_3Si(CH_2)_3N^+(CH_2COOH)_2C_{10}H_{21}$ $Cl^-$ $[H(OC_3H_6)_3O]_3SiCH_2N^+(C_2H_4OH)(CH_3)(C_{12}H_{25})$ $Cl^-$ $[H(OC_2H_4)_{18}O]_3Si(CH_2)_2N^+(O)^-(CH_3)C_{18}H_{37}$ $[CH_3CO(OC_2H_4)_{10}O]_3SiCH_2N^+[(C_2H_4O)_{14}H]_2C_8H_{16}C_6H_5$ $Cl^-$ $[C_{16}H_{33}(OC_2H_4)_8O]_2C_6H_{13}SiCH_2N^+[(C_3H_6O)CH_3](CH_3)_2$ $Br^-$ $[H(OC_4H_8)_8O]_3SiCH_2N^+[(C_2H_4O)_4COCH_3]_2CH_3$ $Cl^-$ $[C_6H_{13}(OC_2H_4)_2O]_3Si(CH_2)_2P^+(CH_3)_2C_{10}H_{21}$ $Br^-$ $[CH_3(OC_3H_6)_{14}O]_3SiCH_2P^+(C_2H_4COOH)(C_6H_{13})_2$ $Cl^-$ $[C_2H_5(OC_2H_4)O]_2CH_3Si(CH_2)_2P^+(C_4H_8OH)(CH_3)C_6H_5$ $Cl^-$ $[CH_3(OC_2H_4)_8O]_3SiCH_2P^+(O)^-(CH_3)C_8H_{17}$ $[C_2H_5CO(OC_2H_4)_2O]_3Si(CH_2)_3P^+[C_2H_4O)_8H]_2C_6H_{13}$ $Cl^-$ $[CH_3(OC_4H_8)O]_3SiCH_2P^+[(C_3H_6O)_2C_7H_{15}](C_4H_9)_2$ $Br^-$ $[C_2H_5CO(OC_2H_4)O]_3SiCH_2S^+(CH_3)C_{18}H_{37}$ $Cl^-$ $[H(OC_2H_4)_4O]_3Si(CH_2)_2S^+(C_2H_4COOH)C_{12}H_{25}$ $Br^-$ $[CH_3(OC_2H_4)_{20}O]_3Si(CH_2)_3S^+(C_3H_6OH)C_{16}H_{33}$ $Br^-$ $[H(OC_3H_6)_{12}O]_3Si(CH_2)_2S^+(O)^-C_5H_{11}$ $[C_{12}H_{25}(OC_2H_4)_4O]_3SiCH_2S^+[(C_2H_4O)_{20}H]CH_3$ $Br^-$ $[H(OC_2H_4)_{12}O]_3Si(CH_2)_3S^+[(C_2H_4O)C_{14}H_{29}[C_6H_4CH_3$ $Cl^-$

Commonly assigned copending patent application "Organosilane Compounds" by Heckert and Watt U.S. Ser. No. 570,539, filed Apr. 22, 1975 discloses the preparation of these compounds. (The disclosure of this application is herein incorporated by reference.)

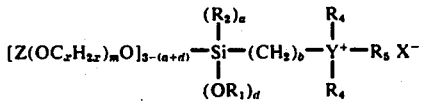

V.

wherein Z is hydrogen, a $C_{1-18}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided $a+d$ does not exceed 2, $b$ is 1–3, $R_4$ is a $C_{1-12}$ alkyl, aryl or arylalkyl group, a carboxy-substituted $C_{1-14}$ alkyl group, $(C_xH_{2x}O)_mZ$ where $x$, $m$ and Z are as defined above, or oxygen provided only one $R_4$ is oxygen, $R_5$ is a $C_{1-22}$ alkyl, aryl or aryl alkyl group, X is halide, and Y is N, S or P.

The compounds of Formula V are formed in substantially the same manner as those of Formula II except that a mixture of $R_1OH$ and $Z(OC_xH_{2x})_mOH$ in the desired ratio is used in place of $R_1OH$ or, alternatively, the compounds of Formula II are heated with less than 3-$a$ equivalents of $Z(OC_xH_{2x})_mOH$ under conditions such that $R_1OH$ is removed from the system.

Examples of illustrative compounds follow:

$[H(OC_2H_4)_5O](CH_3)(C_2H_5O)SiCH_2N^+(CH_3)_2C_{12}H_{25}$ $Cl^-$ $[C_{12}H_{25}(OC_2H_4)_3O](CH_3O)_2Si(CH_2)_3N^+(C_2H_5)_2C_6H_5$ $Cl^-$ $[H(OC_4H_8)_6O](C_2H_5O)_2Si(CH_2)_3N^+[(C_2H_4O)_{10}H]_2C_{18}H_{37}$ $Br^-$ $[CH_3CO(OC_2H_4)_3O]_2(C_2H_5O)Si(CH_2)_2N^+[(C_2H_4O)C_2H_5](C_6H_5CH_3)_2$ $Cl^-$ $[H(OC_2H_4)_{12}O](C_4H_8O)_2SiCH_2N^+[(C_2H_4O)_4COCH_3]_2C_{14}H_{29}$ $Cl^-$ $[C_{16}H_{33}(OC_2H_4)_3O](C_2H_5)(CH_3O)SiCH_2N^+(O)^-(CH_3)C_6H_{13}$ $[H(OC_3H_6)_{12}O](C_2H_5O)_2SiCH_2N^+(C_2H_5COOH)(CH_3)C_{10}H_{21}$ $Cl^-$ $[C_2H_5(OC_2H_4)_{14}O]_2(C_4H_9O)Si(CH_2)_3N^+(C_4H_8OH)(CH_3)C_{14}H_{29}$ $Cl^-$ $[H(OC_2H_4)_{16}O]_2(CH_3O)SiCH_2P^+(CH_3)_2C_6H_4C_2H_5$ $Cl^-$ $[C_3H_7(OC_2H_4)_6O](C_2H_5)(CH_3O)SiCH_2P^+[(C_2H_4O)_8H]_2C_8H_{17}$ $Br^-$ $[CH_3CO(OC_2H_4)_2O]_2(CH_3O)Si(CH_2)_2P^+[(C_3H_6O)_3C_2H_5](C_4H_9)_2$ $Cl^-$ $[H(OC_4H_8)_2O](C_{12}H_{25})(CH_3O)SiCH_2P^+(O)^-(CH_3)C_6H_5{}_2$ $[C_{14}H_{29}(OC_2H_4)_6O](CH_3O)_2SiCH_2P^+(C_3H_6COOH)_2CH_3$ $Cl^-$ $[H(OC_2H_4)_8O]_2(C_4H_9O)SiCH_2P^+(C_3H_6OH)_2C_2H_5$ $Br^-$ $[H(OC_2H_4)_{10}O]_2(C_3H_7O)SiCH_2S^+(CH_3)C_6H_{12}C_6H_5$ $Cl^-$ $[H(OC_4H_8)_2O]_2(CH_3O)Si(CH_2)_3S^+[(C_2H_4O)_4H]CH_3$ $Br^-$ $[C_{12}H_{25}(OC_2H_4)_6O](CH_3)(CH_3O)SiCH_2S^+[(C_3H_6O)_8CH_3]C_3H_7$ $Cl^-$ $[CH_3CO(OC_2H_4)_3O](C_2H_5O)_2Si(CH_2)_2S^+(C_2H_4OH)C_{12}H_{25}\ Cl^-$ $[CH_3(OC_3H_6)_{12}O](CH_3O)_2SiCH_2S^+(C_3H_6COOH)CH_2C_6H_5\ Br^-$ $[H(C_2H_4O)_6O](C_{12}H_{25})(CH_3O)SiCH_2S^+(O)^-C_{14}H_{29}$

Commonly assigned copending patent application "Organosilane Compounds" by Heckert and Watt U.S. Ser. No. 570,539, filed Apr. 22, 1975 discloses the preparation of these compounds. (The disclosure of this application is herein incorporated by reference.)

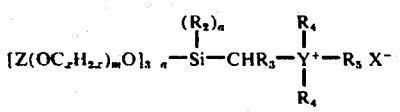

VI.

wherein Z is hydrogen, a $C_{1-18}$ alkyl group or a $C_{1-4}$ acyl group, $x$ is 2–4, $m$ is 1–20, $a$ is 0–2, $R_2$ is a $C_{1-18}$ alkyl group, $R_3$ is a $C_{1-18}$ alkyl group, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide and Y is N, S or P.

The compounds of Formula VI are formed in the same manner as those of Formula III with the exception that $Z(OC_xH_{2x})_mOH$ is used in place of $R_1OH$ during the alcoholysis of the halo-silane. Alternatively, preparation may be effected by the heating of compounds of Formula III with $Z(OC_xH_{2x})_mOH$ under conditions such that all of the $R_1OH$ is removed from the system.

The following compounds illustrate the compounds of Formula VI.

$[CH_3\ (OC_2H_4)_3O]_3SiCH(CH_3)N^+(CH_3)_2C_{18}H_{37}\ Cl^-$ $[C_2H_5(OC_2H_4)O]_2CH_3SiCH(C_2H_5)N^+(C_2H_4OH)_2C_{14}H_{29}\ Cl^-$ $[H(OC_4H_8)_8O]_3SiCH(C_4H_9)N^+(C_2H_4COOH)(C_4H_9)CH_2C_6H_5\ Cl^-$ $[CH_3CO(OC_2H_4)_2O]_3SiCH(C_2H_5)N^+(O)^-(CH_3)C_{10}H_{21}$ $[H(OC_3H_6)_6O]_3SiCH(C_{12}H_{25})N^+[(C_2H_4O)_{10}H]_2CH_3\ Br^-$ $[C_{12}H_{25}(OC_2H_4)O]_3SiCH(C_3H_7)N^+[(C_4H_8O)_3C_5H_{10}](C_2H_5)_2\ Cl^-$ $[C_{10}H_{21}(OC_2H_4)_4O]_3SiCH(C_2H_5)N^+[(CH_2H_4O)_6\cdot COCH_3]_2CH_3\ Cl^-$ $[H(OC_2H_4)_{16}O]_3SiCH(C_8H_{17})P^+(C_2H_5)_2C_6H_4C_4H_9\ Cl^-$ $[CH_3(OC_2H_4)_{16}O]_2C_{12}H_{25}SiCH(CH_3)P^+(C_2H_4COOH)_2C_{10}H_{21}\ Cl^-$ $[C_2H_5OC(OC_2H_4)_5O]_3SiCH(CH_3)P^+(C_2H_4OH)(CH_3)C_{12}H_{25}\ Cl^-$ $[H(OC_2H_4)_2O]_3SiCH(C_{10}H_{25})P^+(O)^-(CH_3)C_{16}H_{33}$ $[H(OC_2H_4)_2O]_3SiCH(C_8H_{17})P^+[(C_2H_4O)_6H]_2C_4H_9\ Br^-$ $[CH_3(OC_4H_8)_2O]_3SiCH(CH_3)P^+[(C_2H_4O)C_8H_{17}](CH_3)_2Cl^-$ $[C_{10}H_{21}(OC_2H_4)_2O]_3SiCH(C_6H_{13})S^+(CH_3)C_{10}H_{21}\ Cl^-$ $[H(OC_2H_4)_{14}O]_2CH_3SiCH(C_8H_{17})S^+(C_2H_4COOH)C_{18}H_{37}\ Cl^-$ $[H(OC_3H_6)_4O]_3SiCH(C_{14}H_{29})S^-(C_4H_8OH)C_6H_5\ Cl^-$ $[CH_3CO(OC_2H_4)_3O]_3SiCH(C_2H_5)S^+(O)^-C_{18}H_{37}$ $[C_{12}H_{25}(OC_2H_4)O]_3SiCH(C_3H_7)S^+[(C_3H_6O)H]C_6H_{13}\ Cl^-$ $[H(OC_4H_8)_4O]_2CH_3SiCH(C_4H_9)S^+[C_2H_4O)_8C_3H_7]CH_3\ Br^-$ Commonly assigned copending patent application "Organosilane Compounds" by Heckert and Watt U.S. Ser. No. 570,537, filed Apr. 22, 1975 discloses the preparation of these compounds. (The disclosure of this application is herein incorporated by reference.)

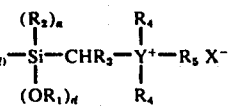

VII.

wherein Z is hydrogen, a $C_{1-18}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided $a+d$ does not exceed 2, $R_3$ is a $C_{1-18}$ alkyl group, $R_4$ is a $C_{1-12}$ alkyl, aryl or arylalkyl group, a carboxy-substituted $C_{1-4}$ alkyl group, $(C_xH_{2x}O)_mZ$ where $x$, $m$ and Z are as defined above, or oxygen provided only one $R_4$ is oxygen, $R_5$ is a $C_{1-22}$ alkyl, aryl or arylalkyl group, X is halide and Y is N, S or P.

Compounds having Formula VII are prepared in substantially the same manner as those of Formula III except that a mixture of $R_1OH$ and $Z(OC_xH_{2x})_mOH$ in the desired ratio is used in place of $R_1OH$. Alternatively, the compounds of Formula III are heated together with less than 3-$a$ equivalents of $Z(OC_xH_{2x})_mOH$ under conditions such that $R_1OH$ is removed from the system.

The following compounds are illustrative of the compounds of Formula VII:

$[H(OC_2H_6)_6O](C_2H_5O)_2SiCH_{12}H_{25}N^+[(C_2H_4O)_{10}H]_2C_{18}H_{37}\ Br^-$ $[CH_3CO(OC_2H_4)_3O]_2(C_2H_5O)SiCHCH_3N^+[(C_2H_4O)C_2H_5]_2C_6H_5CH_3\ Cl^-$ $[H(OC_2H_4)_{12}O](C_4H_8O)_2SiCHC_2H_5N^+[(C_2H_4O)_4\cdot COCH_3]_2C_{14}H_{29}\ Cl^-$ $[C_{16}H_{33}(OC_2H_4)_3O](C_2H_5)\ (CH_3O)SiCHCH_3N^+(O)^-(CH_3)C_8H_{13}$ $[C_2H_5(OC_2H_4)_{14}O]_2(C_4H_9O)SiCHC_6H_{13}N^+(C_6H_{12}OH)\ (CH_3)C_{14}H_{29}\ Cl^-$ $[H(OC_2H_4)_{16}O]_2(CH_3O)SiCHC_4H_9P^+(CH_3)_2C_{18}H_{37}\ Cl^-$ $[CH_3CO(OC_2H_4)_2O]_2(CH_3O)SiCHC_{16}H_{33}P^+[(C_3H_7O)_3C_2H_5](C_4H_9)_2\ Cl^-$ $[C_{14}H_{29}(OC_2H_4)_6O](CH_3O)_2SiCHCH_3P^+(C_3H_6COOH)_2CH_3\ Cl^-$ $[H(OC_2H_4)_{10}O]_2(C_3H_7O)SiCHC_5H_{11}S^+(CH_3)C_{12}H_{25}\ Cl^-$ $[H(OC_4H_8)_2O]_2(CH_3O)SiCHC_8H_{17}S^+CH_3C_6H_5\ Br^-$ Commonly assigned copending patent application "Organosilane Compounds" by Heckert and Watt U.S. Ser. No. 570,537, filed Apr. 22, 1975 discloses the preparation of the compounds. (The disclosure of this application is herein incorporated by reference).

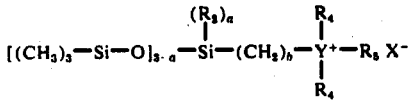

VIII.

wherein $a$ is 0–2, $R_2$ is $C_{1-18}$ alkyl group, $b$ is 1–3, $R_4$ is a $C_{1-12}$ alkyl, aryl or arylalkyl group, a carboxy-substituted $C_{1-14}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

When $a$ is 0, a tris(trimethylsiloxy) silane is used as the starting reactant. Commercially available trihalosilanes and trimethylsilanes are used to produce the starting reactant. Subsequent reaction steps and conditions as discussed in the preparation of compounds of Formula I are used to produce the desired compound of Formula VI.

When $a$ is 1 or 2, a corresponding compound of Formula II is reacted with trimethylchlorosilane at an elevated temperature, e.g., 50° C. to 200° C. to obtain the desired organosilane.

Examples of compounds of Formula VIII are:

$[(CH_3)_3SiO]_3SiCH_2N^+(CH_3)_2C_{14}H_{29}\ Cl^-$ $[(CH_3)_3SiO]_2CH_3Si(CH_2)_3N^+(CH_2COOH)_2C_6H_5\ Cl^-$ $[(CH_3)_3SiO]_3SiCH_2N^+(C_2H_4OH)\ (CH_3)\ (C_{12}H_{25})\ Cl^-$ $[(CH_3)_3SiO]_3Si(CH_2)_2N^+(O)^-(CH_3)C_8H_{17}$ $[(CH_3)_3SiO]_3SiCH_2N^+[(C_2H_4O)_{14}H]_2CH_3\ Cl^-$ $[(CH_3)_3SiO]_2CH_3SiCH_2N^+[(C_3H_6O)CH_3](CH_3)_2\ Br^-$ $[(CH_3)_3SiO]_3SiCH_2N^+[(C_2H_4O)_4COCH_3]_2CH_3\ Cl^-$ $[(CH_3)_3SiO]_3Si(CH_2)_2P^+(CH_3)_2C_{10}H_{21}\ Br^-$ $[(CH_3)_3SiO]_3SiCH_2P^+(C_2H_4COOH)\ (C_6H_{13})_2\ Cl^-$ $[CH_3)_3SiO]_2CH_3Si(CH_2)_2P^+(C_4H_8OH)\ (CH_3)C_{10}H_{21}\ Cl^-$ $[(CH_3)_3SiO]_3SiCH_2P^+(O)^-(CH_3)C_6H_5$ $[(CH_3)_3SiO]_3Si(CH_2)_3P^+[(C_2H_4O)_8H]_2C_6H_{13}\ Cl^-$ $[(CH_3)_3SiO]_3SiCH_2P^+[(C_3H_6O)_2C_7H_{15}]\ (C_4H_9)_2\ Br^-$ $[(CH_3)_3SiO]_3SiCH_2S^+(CH_3)C_{18}H_{37}\ Cl^-$ $[(CH_3)_3SiO]_3Si(CH_2)_2S^+(C_2H_4COOH)C_{12}H_{25}\ Br^-$ $[(CH_3)_3SiO]_3Si(CH_2)_3S^+(C_3H_6OH)C_6H_4CH_3\ Br^-$ $[(CH_3)_3SiO]_3Si(CH_2)_2S^+(O)^-C_{14}H_{29}$ $[(CH_3)_3SiO]_3SiCH_2S^+[(C_2H_4O)_{20}H]CH_3\ Br^-$ $[(CH_3)_3SiO]_3Si(CH_2)_3S^+[(C_2H_4O)C_{14}H_{29}]C_2H_5\ Cl^-$

Commonly assigned copending patent application "Organosilane Compounds" by Heckert and Watt U.S. Ser. No. 570,538, filed Apr. 22, 1975 discloses the preparation of the compounds when $R_4$ is a carboxy-substituted alkyl group or $(C_xH_{2x}O)_mZ$ (The disclosure of this application is herein incorporated by reference.) U.S. Pat. Nos. 2,955,127, 3,624,120 and 3,658,867 discloses the compounds when $R_4$ is alkyl, aryl, arylalkyl or oxygen.

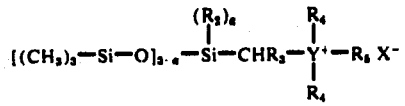

IX.

wherein $a$ is 0–2, $R_2$ is a $C_{1-18}$ alkyl group, $R_3$ is a $C_{1-18}$ alkyl group, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide and Y is N, S or P.

When $a$ is 0, the compounds of Formula IX are prepared following the description given for the preparation of the compounds of Formula III with the exception that a tris(trimethylsiloxy)silane is used as the starting reactant. When $a$ is 1 or 2, a corresponding compound of Formula III is reacted with a trimethylchlorosilane at about 50° C. to 200° C. to produce the desired organosilane.

Illustrative compounds of Formula IX follow:

$[(CH_3)_3SiO]_3SiCH(CH_3)N^+(CH_3)_2C_{18}H_{37}\ Cl^-$ $[(CH_3)_3SiO]_2CH_3SiCH(C_2H_5)N^+(C_2H_4OH)_2C_6H_4CH_3\ Cl^-$ $[(CH_3)_3SiO]_3SiCH(C_4H_9)N^+(C_3H_6COOH)(C_4H_9)_2\ Cl^-$ $[(CH_3)_3SiO]_3SiCH(C_2H_5)N^+(O)^-(CH_3)C_{10}H_{21}$ $[(CH_3)_3SiO]_3SiCH(C_{12}H_{25})N^+[(C_2H_4O)_{10}H]_2CH_3\ Br^-$ $[(CH_3)_3SiO]_3SiCH(C_3H_7)N^+[(C_4H_8O)_3C_5H_{10}](C_2H_5)_2\ Cl^-$ $[(CH_3)_3SiO]_3SiCH(C_2H_5)N^+](C_2H_4O)_6COCH_3]_2CH_3\ Cl^-$ $[(CH_3)_3SiO]_3SiCH(C_8H_{17})P^+(C_2H_5)_2C_8H_{17}\ Cl^-$ $[(CH_3)_3SiO]_2C_2H_5SiCH(CH_3)P^+(C_3H_6COOH)_2C_{10}H_{21}\ Cl^-$ $[(CH_3)_3SiO]_3SiCH(CH_3)P^+(C_2H_4OH)(CH_3)C_{12}H_{25}\ Cl^-$ $[(CH_3)_3SiO]_3SiCH(C_{10}H_{21})P^+(O)^-(CH_3)C_8H_{17}$ $[(CH_3)_3SiO]_3SiCH(C_8H_{17})P^+[(C_2H_4O)_6H]_2C_4H_9\ Br^-$ $[(CH_3)_3SiO]_3SiCH(CH_3)P^+[(C_2H_4O)C_8H_{17}]_2C_6H_4C_2H_5\ Cl^-$ $[(CH_3)_3SiO]_3SiCH(C_6H_{13})S^+(CH_3)C_{16}H_{33}\ Cl^-$ $[(CH_3)_3SiO]_2CH_3SiCH(C_8H_{17})S^+(C_2H_4COOH)C_6H_5\ Cl^-$ $[(CH_3)_3SiO]_3SiCH(C_{14}H_{29})S^+(C_4H_8OH)CH_3\ Cl^-$ $[(CH_3)_3SiO]_3SiCH(C_2H_5)S^+(O)^-C_{18}H_{37}$ $[(CH_3)_3SiO]_3SiCH(C_3H_7)S^+[(C_3H_6O)H]C_{12}H_{25}\ Cl^-$ $[(CH_3)_3SiO]_2C_{18}H_{37}SiCH(C_4H_9)S^+[(C_2H_4O)_8C_3H_7]CH_3\ Br^-$

Commonly assigned copending patent application "Organosilane Compounds" by Heckert and Watt U.S. Ser. No. 570,537, filed Apr. 22, 1975 discloses the preparation of these compounds. (The disclosure of this application is herein incorporated by reference.)

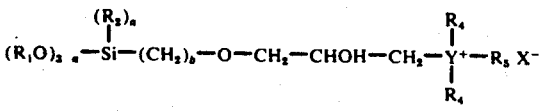

X.

wherein $R_1$ is a $C_{1-4}$ alkyl group, $a$ is 0–2, $R_2$ is a $C_{1-18}$ alkyl group, $b$ is 1–3, $R_4$ is a $C_{1-12}$ alkyl, aryl or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is halide, and Y is N, S or P.

The compounds of Formula X are prepared by initially reacting (when $a$ is 0 and $b$ is 3) trihalosilane with an alcohol ($R_1OH$) at 0° C. to 50° C. for 1 to 10 hours to produce a trialkoxysilane. This silane is then reacted with an allylglycidylether

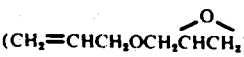

in the presence of 0.01% to 0.1% chloroplatinic acid or platinum at 100° C. for 2 to 10 hours. The resultant product

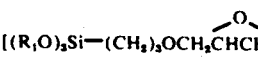

is reacted with a tertiary amine, tertiary phosphine, or dialkylsulfide in the presence of an acid in an inert solvent at 60° C. to 100° C. for 1 to 10 hours to produce the compound of Formula X.

When $a$ is 1 or 2, the preparation of the compounds is essentially the same except for the use of an alkyl substituted silane as the starting reactant.

When $b$ is 2 in Formula X, a trihalovinylsilane of formula $X_3SiCH{=}CH_2$ (which is commercially available) is reacted with hydrogen bromide in the presence of peroxide or light to produce a beta-haloethyltrihalosilane. This compound is reacted with an alcohol, an allylglycidylether, and finally with an appropriate amine, phosphine, or sulfide in the manner discussed above for the preparation of the compounds of Formula X when $b$ is 3.

When $b$ is 1 in Formula X, the starting reactant is a commercially available trihalomethylsilane of formula $X_3SiCH_3$.

This silane is reacted with chlorine or, preferably a half mole of bromine and a half mole of chlorine in the presence of light (such as provided by an ordinary tungsten or fluorescent lamp). The resultant alphahalomethyltrihalosilane is reacted with an alcohol, an allylglycidylether, and finally an appropriate amine, phosphine, or sulfide in the manner discussed above with the compounds of Formula X when $b$ is 3.

The following compounds illustrate the compounds of Formula X.

$(CH_3O)_3Si(CH_2)_3OCH_2CHOHCH_2N^+(CH_3)_2C_{16}H_{33}$ $Cl^-$ $(CH_3O)_2C_{12}H_{25}SiCH_2OCH_2CHOHCH_2N^+(C_3H_6COOH)(C_4H_9)C_8H_{17}$ $Cl^-$ $(C_2H_5O)_3Si(CH_2)_2OCH_2CHOHCH_2N^+(C_2H_4OH)_2C_6H_5$ $Br^-$ $(CH_3O)_3Si(CH_2)_3OCH_2CHOHCH_2N^+(O)^-(CH_3)C_8H_{17}$ $(CH_3O)_3SiCH_2OCH_2CHOHCH_2N^+[(C_2H_4O)H]_2C_{14}H_{29}$ $Br^-$ $(CH_3O)_2C_2H_5SiCH_2OCH_2CHOHCH_2N^+[(C_3H_6O)_{12}C_2H_5](CH_3)_2$ $Cl^-$ $(C_4H_9O)_3SiCH_2OCH_2CHOHCH_2N^+[(C_2H_4O)_3COCH_3]_2CH_3$ $Br^-$ $(CH_3O)_3SiCH_2OCH_2CHOHCH_2P^+(C_4H_9)_2CH_2C_6H_5$ $Br^-$ $(C_4H_9O)_3SiCH_2OCH_2CHOHCH_2P^+(C_2H_4COOH)_2C_8H_{17}$ $Cl^-$ $(CH_3O)_3Si(CH_2)_2OCH_2CHOHCH_2P^+(C_2H_4OH)(C_2H_5)C_{10}H_{21}Cl^-$ $(CH_3O)_3SiCH_2OCH_2CHOHCH_2P^+(O)^-(CH_3)$ $C_{18}H_{37}$ $(CH_3O)_3SiCH_2OCH_2CHOHCH_2P^+[C_3H_6O)_{18}H]_2CH_3$ $Br^-$ $(C_2H_5O)$ $(CH_3)_2SiCH_2OCH_2CHOHCH_2P^+[(C_2H_4O)CH_3]_2C_6H_{13}$ $(CH_3O)_3SiCH_2OCH_2CHOHCH_2S^+(CH_3)C_6H_4CH_3$ $Cl^-$ $(CH_3O)_2C_{16}H_{37}SiCH_2OCH_2CHOHCH_2S^+(C_2H_4COOH)C_8H_{17}$ $Cl^-$ $(CH_3O)_3Si(CH_2)_2OCH_2CHOHCH_2S^+(C_2H_4OH)C_6H_{13}$ $Cl^-$ $(C_2H_5O)_3SiCH_2OCH_2CHOHCH_2S^+(O)^-C_{10}H_{21}$ $(CH_3O)_3SiCH_2OCH_2CHOHCH_2S^+[(C_2H_4O)_{12}H]CH_3$ $Br^-$ $(C_2H_5O)_3SiCH_2OCH_2CHOHCH_2S^+[(C_2H_4O)_2C_8H_{17}]C_2H_5$ $Br^-$

Commonly assigned copending patent application "Organosilane Compounds" by Heckert and Watt U.S. Ser. No. 570,531, filed Apr. 22, 1975 discloses the preparation of these compounds. (The disclosure of this application is herein incorporated by reference.)

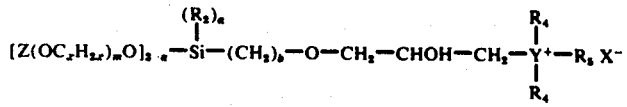

XI.

wherein Z is hydrogen, a $C_{1-18}$ alkyl group or a $C_{1-4}$ acyl group, $x$ is 2–4, $m$ is 1–20, $a$ is 0–2, $R_2$is a $C_{1-18}$ alkyl group, $b$ is 1–3, $R_4$ is a $C_{1-12}$ alkyl, aryl, or arylalkyl group, a carboxy-substituted $C_{1-4}$ alkyl group, $(C_xH_{2x}O)_mZ$ where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is a $C_{1-22}$ alkyl, aryl or arylalkyl group, X is a halide, and Y is N, S or P.

Compounds of Formula XI are prepared in a manner identical with that of Formula X except that $R_1OH$ is replaced by $$HO(C_xH_{2x}O)_mZ.$$

The following compounds are exemplary of Formula XI compounds.

$[H(OC_2H_4)_{20}O]_3SiCH_2OCH_2$-
$CHOHCH_2N^+(CH_3)_2C_{10}H_{21}$ $Cl^-$
$[CH_3(OC_3H_6)_{10}O]_2CH_3SiCH_2OCH_2$-
$CHOHCH_2N^+(C_2H_4COOH)$ $(C_4H_9)_2$ $Cl^-$
$[C_2H_5(OC_2H_4)_2O]_3Si(CH_2)_3OCH_2CHOHCH_2N^+(C_2$-
$H_4OH)_2(C_8H_{17})$ $Cl^-$
$[C_8H_{17}(OC_2H_4)O]_3SiCH_2OCH_2CHOHCH_2N$-
$^+(O)^-(C_4H_9)C_6H_5$
$[CH_3CO(OC_2H_4)_6O]_3Si(CH_2)_2OCH_2$-
$CHOHCH_2N^+[(C_2H_4O)_{10}H]_2CH_3$ $Cl^-$
$[H(OC_3H_6)_8O]_2C_{16}H_{33}SiCH_2OCH_2$-
$CHOHCH_2N^+[(C_2H_4O)_8C_4H_9](CH_3)_2$ $Br^-$
$[C_2H_5(OC_2H_4)_4O]_3SiCH_2OCH_2CHOHCH_2N^+[(C_2$-
$H_4O)_2COCH_3]_2CH_3$ $Br^-$
$[C_{18}H_{39}(OC_2H_4)_3O]_3SiCH_2OCH_2$-
$CHOHCH_2P^+(C_2H_5)_2C_{14}H_{29}$ $Cl^-$
$[H(OC_3H_6)_8]_3Si(CH_2)_3OCH_2CHOHCH_2P^+(C_3H$-
$_6COOH)_2C_6H_{13}$ $Cl^-$
$[C_8H_{17}(OC_2H_4)_2O]_2CH_3SiCH_2OCH_2$-
$CHOHCH_2P^+(C_2H_4OH)(CH_3)C_8H_{17}$ $Cl^-$
$[CH_3(OC_3H_6)O]_3Si(CH_2)_3OCH_2CHOHCH_2P$-
$^+(O)^-(CH_3)C_{10}H_{21}$
$[C_2H_5(OH_4C_2)_{12}O]_3Si(CH_2)_2OCH_2$-
$CHOHCH_2P^+[(C_2H_4O)_2H]_2C_6H_4CH_3$ $Br^-$
$[CH_3CO(OC_2H_4)_8O]_3SiCH_2OCH_2CHOHCH_2P^+[(C_3$-
$H_6O)_8C_2H_5](C_4H_9)_2$ $Cl^-$
$[H(OC_2H)_4O]_3SiCH_2OCH_2$-
$CHOHCH_2S^+(CH_3)C_{18}H_{37}$ $Cl^-$
$[C_{16}H_{33}(OC_2H_4)_6O]_2C_{12}H_{25}SiCH_2OCH_2$-
$CHOHCH_2S^+(C_3H_6COOH)C_{10}H_{21}$ $Cl^-$
$[CH_3(OC_4H_8)_4O]_3SiCH_2OCH_2CHOHCH_2S^+(C_4$-
$H_8OH)C_8H_{17}$ $Br^-$
$[H(OC_2H_4)_{14}O]_3Si(CH)_2OCH_2CHOHCH_2S^+$-
$(O)^-C_{12}H_{14}C_6H_5$
$[C_9H_{19}(OC_2H_4)O]_3SiCH_2OCH_2CHOHCH_2S^+[(C_2$-
$H_4O)_6H]C_6H_{13}$ $Cl^-$
$[C_2H_5CO(OC_2H_4)_2O]_3SiCH_2OCH_2$-
$CHOHCH_2S^+[(C_4H_8O)_{12}CH_3]C_8H_{17}$ $Cl^-$

Commonly assigned copending patent application "Organosilane Compounds" by Heckert and Watt U.S. Ser. No. 570,531, filed Apr. 22, 1975 discloses the preparation of these compounds. (The disclosure of this application is herein incorporated by reference.)

$$[Z(OC_xH_{2x}O)_mO]_{3-(a+d)}-\underset{(OR_1)_d}{\overset{(R_2)_a}{Si}}-(CH_2)_b-O-CH_2-CHOH-CH_2-\underset{R_4}{\overset{R_4}{Y^+}}-R_5\ X^- \qquad \text{XII.}$$

wherein Z is hydrogen, a $C_{1-18}$ alkyl group or a $C_{1-4}$ acyl group, $x$ is 2–4, $m$ is 1–20, $R_2$ is a $C_{1-18}$ alkyl group, $R_1$ is a $C_{1-4}$ alkyl group, $a$ is 0 or 1, $d$ is 1 or 2 provided a+d does not exceed 2, $b$ is 1–3, $R_4$ is a $C_{1-12}$ alkyl, aryl or arylalkyl group, a carboxy-substituted $C_{1-14}$ alkyl group, $$(C_xH_{2x}O)_mZ$$

where $x$, $m$ and Z are as defined above, or oxygen provided only one $R_4$ is oxygen, $R_5$ is a $C_{1-22}$ alkyl, aryl or arylalkyl group, X is halide, and Y is N, S or P.

These compounds are prepared in a manner similar to that described for the compounds of Example XI except that only a part of the $R_1OH$ is replaced by $$HO(C_xH_{2x}O)_mZ.$$

The following compounds are examples of compounds having the Formula XII.

$[H(OC_2H_4)_{12}O](CH_3O)_2SiCH_2OCH_2$-
$CHOHCH_2N^+(CH_3)_2C_{18}H_{37}$ $Cl^-$
$[H(OC_3H_6O)_3O](C_2H_5)(CH_3)Si(CH_2)_2OCH_2$-
$CHOHCH_2N^+(CH_2COOH)(C_4H_9)_2$ $Cl^-$
$[C_{12}H_{25}(OC_2H_4)_9O](C_2H_5O)_2SiCH_2OCH_2$-
$CHOHCH_2N^+(C_4H_8OH)_2CH_3$ $Cl^-$
$[CH_3(OC_4H_8)_2O]_2(C_4H_9O)Si(CH_2)_3OCH_2$-
$CHOHCH_2N^+(O)^-(CH_3)$ $C_{16}H_{33}$
$[CH_3CO(OC_2H_4)_6O]_2(CH_3O)SiCH_2OCH_2$-
$CHOHCH_2N^+[(C_2H_4O)_8H]_2CH_3Br^-$
$[H(OC_2H_4)_{18}O](C_2H_5O)(C_{16}H_{33})SiCH_2OCH_2$-
$CHOHCH_2N^+[(C_2H_4O)C_{12}H_{25}](CH_3)_2$ $Cl^-$
$[H(OC_2H_4)_8O](C_2H_5)_2SiCH_2OCH_2$-
$CHOHCH_2P^+(CH_3)_2C_6H_5$ $Cl^-$
$[CH_3(OC_2H_4)_6O](C_{12}H_{25})(CH_3O)SiCH_2OCH_2$-
$CHOHCH_2P^+[(C_2H_4O)_6OCH_3]_2(CH_3)$ $Cl^-$
$[CH_3CO(OC_3H_6)_4O]_2(CH_3O)Si(CH_2)_3OCH_2$-
$CHOHCH_2P^+(C_4H_8OH)_2CH_3$ $Cl^-$
$[H(OC_4H_8)_2O](CH_3O)(CH_3)SiCH_2OCH_2$-
$CHOHCH_2S^+[(C_2H_4O)_3H]C_2H_5$ $Cl^-$
$[C_{12}H_{25}(OC_2H_4O](C_4H_9O)_2Si(CH_2)_2OCH_2$-
$CHOHCH_2S^+(C_3H_6COOH)CH_3$ $Br^-$
$[C_2H_5CO(OC_2H_4)_{10}O]_2(C_2H_5O)SiCH_2OCH_2$-
$CHOHCH_2S^+(O)^-C_{12}H_{25}$

Commonly assigned copending patent application "Organosilane Compounds" by Heckert and Watt U.S. Ser. No. 570,531, filed Apr. 22, 1975 of these compounds. (The disclosure of this application is herein incorporated by reference.)

$$[(CH_3)_3-Si-O]_{3-a}-\overset{(R_2)_a}{Si}-(CH_2)_b-O-CH_2-CHOH-CH_2-\underset{R_4}{\overset{R_4}{Y^+}}-R_5\ X^- \qquad \text{XIII.}$$

wherein $a$ is 0–2, $R_2$ is a $C_{1-18}$ alkyl group, $b$ is 1–3, $R_4$ is a $C_{1-12}$ alkyl, aryl or arylalkyl group, a carboxy-substituted $C_{1-4}$ group, $$(C_xH_{2x}O)_mZ$$

where $x$ is 2–4, $m$ is 1–20, and Z is hydrogen, a $C_{1-18}$ alkyl group or a $C_{1-4}$ acyl group, or oxygen provided only one $R_4$ is oxygen, $R_5$ is $C_{1-22}$ alkyl, aryl or arylalkyl group, X is halide, and Y is N, S or P.

Tris(trimethylsiloxy)silanes, which are prepared from commercially available trimethylhalosilanes and trihalosilanes, are used as the starting reactants when *a* is 0. Subsequent reaction steps and conditions as discussed with the preparation of compounds of Formula X are used to produce the desired compound of Formula XIII.

When *a* is 1 or 2, a compound of Formula X is reacted with trimethylchlorosilane at an elevated temperature, e.g. 50° C. to 200° C. to obtain the desired organosilane.

The following compounds are illustrative of the compounds of Formula XIII.

$[(CH_3)_3SiO]_3SiCH_2OCH_2CHOHCH_2N^+(CH_3)_2C_{10}H_{21}\ Cl^-$ $[(CH_3)_3SiO]_2CH_3SiCH_2OCH_2CHOHCH_2N^+(C_2H_4COOH)\ (C_4H_9)_2\ Cl^-$ $[(CH_3)_3SiO]_3Si(CH_2)_3OCH_2CHOHCH_2N^+(C_2H_4OH)_2C_8H_{17}\ Cl^-$ $[(CH_3)_3SiO]_3SiCH_2OCH_2CHOHCH_2N^+(O)^-(C_2H_5)C_6H_4C_2H_5$ $[(CH_3)_3SiO]_3Si(CH_2)_2OCH_2CHOHCH_2N^+[(C_2H_4O)_{10}H]_2CH_3\ Cl^-$ $[(CH_3)_3SiO]_2C_2H_5SiCH_2OCH_2CHOHCH_2N^+[(C_2H_4O)_8C_4H_9](CH_3)_2\ Br^-$ $[(CH_3)_3SiO]_3SiCH_2OCH_2CHOHCH_2N^+[(C_3H_6O)_2COCH_3]_2CH_3\ Br^-$ $[(CH_3)_3SiO]_3SiCH_2OCH_2CHOHCH_2P^+(C_2H_5)_2C_{14}H_{29}\ Cl^-$ $[(CH_3)_3SiO]_3Si(CH_2)_2OCH_2CHOHCH_2P^+(C_3H_6COOH)_2C_6H_5\ Cl^-$ $[(CH_3)_3SiO]_2CH_3SiCH_2OCH_2CHOHCH_2P^+(C_2H_4OH)\ (CH_3)C_8H_{17}\ Cl^-$ $[(CH_3)_3SiO]_3Si(CH_2)_3OCH_2CHOHCH_2P^+(O)^-(CH_3)C_{10}H_{21}$ $[(CH_3)_5SiO]_3Si(CH_2)_2OCH_2CHOHCH_2P^+[(C_2H_4O)_2H]_2C_{10}H_{21}\ Br^-$ $[(CH_3)_3SiO]_3SiCH_2OCH_2CHOHCH_2P^+[(C_3H_6O)_8C_2H_5](C_4H_9)_2\ Cl^-$ $[(CH_3)_3SiO]_3SiCH_2OCH_2CHOHCH_2S^+(CH_3)C_{18}H_{37}\ Cl^-$ $[(CH_3)_3SiO]_2C_{12}H_{25}SiCH_2OCH_2CHOHCH_2S^+(C_3H_6COOH)C_{10}H_{21}\ Cl^-$ $[(CH_3)_3SiO]_3SiCH_2OCH_2CHOHCH_2S^+(C_4H_8OH)C_8H_{17}\ Br^-$ $[(CH_3)_3SiO]_3Si(CH_2)_2OCH_2CHOHCH_2S^+(O)^-C_{16}H_{33}$ $[(CH_3)_3SiO]_3SiCH_2OCH_2CHOHCH_2S^+[(C_2H_4O)_6H)]C_6H_4CH_3\ Cl^-$ $[(CH_3)_3SiO]_3SiCH_2OCH_2CHOHCH_2S^+[(C_4H_8O)_{12}CH_3]C_8H_{17}\ Cl^-$

U.S. Pat. No. 3,389,160 discloses compounds of Formula XIII when $R_4$ is an alkyl, aryl, or arylalkyl group. Commonly assigned patent application, "Organosilane Compounds" by Heckert and Watt, U.S. Ser. No. 570,538, filed Apr. 22, 1975 discloses the preparation of the other compounds. (The disclosure of this application is herein incorporated by reference.)

Siloxane oligomers of the above organosilanes are also useful in the present invention. Such oligomers are formed from the monomers by the controlled addition of from 1 to 100 equivalents of water, preferably in an inert solvent such as alcohol, tetrahydrofuran, etc. As used herein, "oligomers" is used to mean a degree of polymerization of from 2 to 100, preferably 2 to 20. A higher degree of polymerization adversely affects the ability of the compound to bond itself to the hard surface and is for this reason avoided. Examples of siloxane oligomers having varying degress of polymerization are readily visualized from the above examples of organosilane monomers.

Water-soluble organic detergents selected from the group consisting of nonionic detergents, zwitterionic detergents, ampholytic detergents and mixtures thereof are used. U.S. Pat. No. 3,579,454 issued May 18, 1971 to Everett J. Collier, Col. 12, line 16 to Col. 13, line 64, (the disclosure of which is herein incorporated by reference) describes suitable detergents which fall within the abovedescribed classes. The nonionic detergents are preferred. The ratio of organosilane to organic detergent is from 2:1 to 1:10,000, preferably 1:1 to 1:500, most preferably 1:3 to 1:60. An amount of organosilane below 1:10,000 does not initially provide a noticeable soil release benefit and is, for this reason, avoided. (A benefit is realized from compositions containing a ratio of organosilane to detergent less than 1:10,000 after repeated washings due to a gradual buildup of deposited organosilane but is, for all practical purposes, too gradual to be of significance.) The upper level of organosilane in the composition is dictated by cost and the absence of any further noticeable soil release benefit. Generally, the amount of organosilane in a composition does not exceed 50% for a rinse aid type product and 10% for other detergent compositions.

When metallic or vitreous surfaces are contacted with a detergent composition containing the abovedescribed organosilanes, a thin coating of the organosilane is attached to the surfaces. It is theorized that the positively charged organosilane is attracted to a negatively charged metallic or vitreous surface. The silicon atom in the organosilane forms a bond with the surface. The presence of the positive charge on the organosilane is necessary to allow the bonding to take place within a reasonable time period when the organosilane is applied from a dilute system such as is normally encountered in detergent compositions. The terminal alkyl groups attached to the positively charged compound provide the soil release benefits. It is believed that the organosilane compound polymerizes on the surface to form a thin coating of the polymer. The coating is responsible for imparting the soil release benefits to the surface. That is, a hard surface having on it the polymeric coating will be soiled; however, the soil is not tenaciously bound to the surface by virtue of the coating and for this reason is easily washed away.

Repeated washings can subsequently remove the polymeric coating. However, the soil release benefit is renewed by using the detergent compositions of this invention. The ability to provide a soil release benefit from a wash or rinse solution is especially beneficial in that it allows the consumer to efficiently and economically impart the benefit to a hard surface without adversely affecting its appearance.

Detergent compositions in which the organosilane compound is included are described in the following paragraphs.

RINSE AID

Rinse aids are intended to be used in automatic dishwashing machines used either in the home or in commercial establishments. At the end of the cleaning cycle, it is desirable that the rinse water which is sprayed onto tableware and cooking utensils drain uniformly.

Such uniform draining assures that spots of water do not remain behind. Invariably the water will contain dissolved substances which will leave behind a residue when dried. The inclusion of a rinse aid in the final rinse step insures that very little water is left behind on the dishes. The rinse aids of this invention consist essentially of from 0.1% to 50%, preferably 1% to 10% of the organosilane; from 5% to 99.9%, preferably 10% to 50% of the water-soluble organic nonionic detergent; and the balance water. Optionally from 1% to 30%, preferably 5% to 10% of a sequestering agent, e.g. phosphoric, glycolic, tartaric, succinic, citric, lactic, fumaric, or glyconic acid is included in the composition.

CAR WASH DETERGENT COMPOSITIONS

A composition intended for use in automatic car washes consists essentially of from 0.01% to 10%, preferably 0.1% to 2% of the organosilane; from 20% to 35%, preferably 23% to 28% of the water-soluble nonionic, zwitterionic, and/or ampholytic organic detergent; and the balance water. Optionally, from 1% to 10%, preferably 1% to 3% of magnesium sulfate is included in the composition.

LIGHT DUTY LIQUID DETERGENT COMPOSITION

Light duty liquid detergent compositions are used for hand washing of cooking utensils and tableware. Such compositions consist essentially of from 0.01% to 10%, preferably 0.1% to 2% of the organosilane; from 10% to 90%, preferably 20% to 40% of the water-soluble nonionic, zwitterionic, and/or ampholytic detergent; and the balance water. Optionally, an electrolyte such as potassium chloride or sodium chloride is included in the composition at a level of from 0.5% to 5%, preferably 1% to 2%. Other optional components include a hydrotrope, e.g. toluene sulfonate, cumene sulfonate or xylene sulfonate at a level of from 1% to 20%, preferably 2% to 5%, and a lower alcohol, e.g. a $C_{1-4}$ alcohol at a level of from 1% to 20%, preferably 3% to 10%.

AUTOMATIC DISHWASHING DETERGENT COMPOSITION

A detergent composition intended to be used in the home in an automatic dishwashing machine is also encompassed by this invention. Such compositions consist essentially of from 0.01% to 5%, preferably 0.1% to 2% of the organosilane; from 0.1% to 15%, preferably 1% to 5% of the water-soluble nonionic detergent; from 5% to 60%, preferably 30% to 50% of a water-soluble organic or inorganic alkaline builder salt; and the balance inert filler salts. Suitable water-soluble organic and inorganic alkaline builder salts include the following: sodium tripolyphosphate, sodium citrate, sodium carbonate and sodium nitrilotriacetate.

Sodium sulfate and sodium chloride are suitable inert filler salts normally included in detergent compositions of this type.

These compositions can additionally contain from 7% to 35%, preferably 10% to 20%, of an alkali metal silicate having a $SiO_2$:$M_2O$ ratio of from 3.6:1 to 1:2, preferably 2:1 to 3.2:1 wherein M is an alkali metal, e.g. sodium. The composition can optionally also contain a bleach in an amount sufficient to give the product an available chlorine content of from 0.5% to 10%, preferably 1% to 5%. Any suitable chlorine yielding bleach can be used. Examples are as follows: chlorinated trisodium phosphate, dichlorocyanuric acid; salts of chlorine substituted cyanuric acid; 1,3-dichloro-5,5-dimethylhydantoin; paratoluene sulfodichloroamide; trichloromelamine; N-chlorosucinimide; N,N'-dichloroazodicarbonamide; N-chloroacetyl urea; N,N'-dichlorobiuret; chlorinated dicyandiamide; sodium hypochlorite; calcium hypochlorite; and lithium hypochlorite.

COMMERCIAL AUTOMATIC DISHWASHING DETERGENT COMPOSITION

A commercial dishwashing composition consists essentially of from 0.01% to 5%, preferably 0.1% to 2% of the organosilane; from 0.1% to 15%, preferably 1% to 5% of the water-soluble nonionic detergent; from 5% to 60%, preferably 30% to 50% of a water-soluble organic or inorganic alkaline builder salt; from 10% to 40%, preferably 10% to 30% of an alkali metal base; and the balance inert filler salts.

Suitable water-soluble organic or inorganic alkaline builder salts are described above in connection with the automatic dishwashing detergent composition. Examples of alkali metal bases are sodium hydroxide and potassium hydroxide.

An alkali metal silicate or a chlorine bleach as described above in connection with the automatic dishwashing detergent composition can be added herein at the same levels.

WINDOW CLEANER

Window cleaner compositions contain from 0.001% to 5%, preferably 0.002% to 1% of the organosilane. The remainder of the window cleaner composition consists essentially of from 0.1% to 5%, preferably 0.5% to 3% of the water-soluble nonionic, zwitterionic, and/or ampholytic organic detergent and the balance an organic inert solvent or solvent/water mixture. Suitable organic inert solvents include the following: methanol, ethanol, isopropanol, acetone and methyl ethyl ketone.

ABRASIVE CLEANER

The organosilane of this invention is also used in a detergent composition intended for the cleaning of hard surfaces such as ovens. Such compositions consist essentially of from 0.002% to 5%, preferably 0.01% to 1% of the organosilane, from 0.1% to 10%, preferably 1% to 5% of the water-soluble nonionic, zwitterionic, and/or ampholytic organic detergent; from 50% to 95%, preferably 50% to 75% of a water-insoluble abrasive; and the balance inert filler salts. Suitable abrasives include the following: quartz, pumicite pumice, talc, silica sand, calcium carbonate, china clay, zirconium silicate, bentonite, diatomaceous earth, whiting, feldspar, and aluminum oxide.

IN-TANK TOILET BOWL CLEANERS

The compositions of this invention are useful as an in-tank toilet bowl cleaner. Such compositions consist essentially of from 0.01% to 10%, preferably 0.5% to 2% of the organosilane; from 0.1% to 5%, preferably 0.5% to 2% of sodium bisulfate; from 0.1% to 20%, preferably 1% to 15% of a lower, i.e. $C_{1-4}$ alcohol; from 0.5% to 20%, preferably 1% to 15% of the water-soluble organic, nonionic, zwitterionic or ampholytic detergent or mixtures thereof; and the balance water.

The following examples are illustrative of this invention.

EXAMPLE I

The organosilanes of this invention are tested for their ability to provide a soil release benefit to hard surfaces in the manner described immediately below.

A solution of 0.003% organosilane and 0.01% tallow alcohol ethoxylated with 9 moles of ethylene oxide in distilled water is prepared. The solution has a temperature of 55° C. A clean glass slide is dipped into the solution and held there for 10 minutes. The solution is continuously mixed while the glass slide is being treated. After the 10 minute hold time, the glass slide is removed and rinsed with tap water having a temperature of about 15° C. The rinsed slide is dried at 72° C. for 20 minutes.

Next the slide is soiled by dipping it into an oatmeal slurry for 15 seconds and baking it for 20 minutes at 72° C. Thereafter, the slide is washed with distilled water in a Tergotometer for 3 minutes at 55° C. The resultant slide is dyed with a solution of iodide and potassium iodide in water to facilitate its grading.

The slide is graded visually and assigned a number ranging from 0 (equal to an untreated glass slide, i.e., the control) to 4 (a totally clean slide). Intermediate grades of 1 (slightly better than control), 2 (a definite noticeable improvement) and 3 (slide is almost clean) are used.

Each organosilane is tested 5 times in the manner above described and its average is recorded. The individual organosilanes and their grades are reported below.

| | Grade |
|---|---|
| $(C_2H_5O)_3SiCH_2N^+(CH_3)_2C_{12}H_{25}$ $Cl^-$ | 4 |
| $(C_2H_5O)_3SiCH_2P^+(CH_3)_2C_{12}H_{25}$ $Cl^-$ | 4 |
| $(C_2H_5O)_3Si(CH_2)_2N^+(CH_3)_2C_{12}H_{25}$ $Cl^-$ | 4 |
| $(C_2H_5O)_3Si(CH_2)_3N^+(CH_3)_2C_{12}H_{25}$ $Br^-$ | 4 |
| $(C_2H_5O)_3SiCH_2N^+(CH_3)_2C_6H_{13}$ $Cl^-$ | 1 |
| $(CH_3O)_3SiCH_2N^+(CH_3)_2C_6H_5$ $Cl^-$ | 1 |
| $(C_2H_5O)_3SiCH_2N^+(CH_3)_2C_{18}H_{37}$ $Cl^-$ | 4 |
| $(C_2H_5O)_3SiCH_2S^+(CH_3)C_{18}H_{37}$ $Cl^-$ | 4 |
| $(C_4H_9O)_3SiCH_2N^+(CH_3)_2C_{12}H_{25}C_6H_5$ $Cl^-$ | 4 |
| $(CH_3O)_3SiCH_2N^+[(C_3H_6O)_3C_2H_5]_2C_8H_{17}$ $Cl^-$ | 1 |
| $(C_2H_5O)_3Si(CH_2)_3N^+(C_2H_5)[(C_4H_9O)_8H]C_4H_9$ $Cl^-$ | 1.5 |
| $(C_2H_5O)_3SiCH_2N^+(C_2H_7COOH)_2C_8H_{17}$ $Cl^-$ | 1 |
| $(C_2H_5O)_3SiCH_2N^+[(C_2H_4O)_4COCH_3]_2C_{18}H_{37}$ $Cl^-$ | 2.5 |
| $[(CH_3)_3SiO]_2SiCH_2N^+(CH_3)_2C_{12}H_{25}$ $Br^-$ | 4 |
| $(C_2H_5O)_3SiCH(C_{12}H_{25})N^+(C_2H_5)_3$ $Cl^-$ | 4 |
| $(C_2H_5O)_3SiCH(C_{12}H_{25})P^+(C_2H_5)_3$ $Cl^-$ | 4 |
| $(CH_3O)_2CH_3SiCH(C_{18}H_{37})N^+(CH_3)_3$ $Br^-$ | 4 |
| $(CH_3O)_2CH_3SiCH(C_{18}H_{37})S^+(CH_3)_2$ $Br^-$ | 4 |
| $(C_2H_5O)_3SiCH_2N^+(O)^-(CH_3)C_{14}H_{29}$ | 4 |
| $(C_2H_5O)_3SiCH_2S^+(O)^-C_{14}H_{29}$ | 4 |
| $(CH_3O)_3Si(CH_2)_3N^+(CH_3)_2C_6H_4C_3H_7$ $Cl^-$ | 3 |
| $(CH_3O)_3SiCH_2N^+(C_2H_4OH)$ $(CH_3)C_{12}H_{25}$ $Cl^-$ | 4 |
| $(CH_3O)_3Si(CH_2)_3OCH_2CHOHCH_2N^+$ $(CH_3)_2C_8H_{17}$ $Cl^-$ | 1.5 |
| $(C_2H_5O)_2C_4H_9SiCH_2N^+(CH_3)_2C_{12}H_{25}$ $Cl^-$ | 4 |
| $[H(OC_2H_4)_{18}O]_2SiCH_2N^+(C_2H_5)_2C_{18}H_{37}$ $Cl^-$ | 4 |
| $[CH_3(OC_2H_4)_{12}O]_2CH_3SiCH_2N^+(CH_3)_2C_{12}H_{25}$ $Br^-$ | 4 |
| $[CH_3CO(OC_2H_4)_4]_3Si(CH_2)_3N^+(CH_3)_2C_{10}H_{21}$ $Cl^-$ | 4 |
| $[H(OC_2H_4)_8](CH_3O)_2SiCH_2N^+(CH_3)_2C_{12}H_{25}$ $Cl^-$ | 4 |
| $[CH_3(OC_2H_4)_6O]_2SiCH(C_{12}H_{25})N^+(CH_3)_3$ $Br^-$ | 4 |
| $[H(OC_2H_4)_2O]_2(CH_3O)SiCH(C_8H_{17})N^+$ $(CH_3)_2C_8H_{13}$ $Cl^-$ | 4 |
| $[(CH_3)_3SiO]_2SiCH(C_{16}H_{37})N^+(CH_3)_2C_4H_9Cl^-$ | 4 |
| $[H(OC_2H_4)_4O]_2SiCH_2OCH_2CHOHCH_2N^+$ $(CH_3)_2C_{12}H_{25}$ $Cl^-$ | 3 |
| $[CH_3(OC_2H_4)_6O]_2(CH_3O)SiCH_2OCH_2CHOHCH_2N^+$ $(C_4H_9)_3$ $Cl^-$ | 2 |
| $[(CH_3)_3SiO]_2SiCH_2OCH_2CHOHCH_2N^+$ $(CH_3)_2C_{14}H_{29}$ $Br^-$ | 4 |
| $[(CH_3)_3SiO]_2SiCH_2OCH_2CHOHCH_2P^+$ $(CH_3)_2C_{14}H_{29}$ $Br^-$ | 4 |
| Siloxane dimer of $(C_2H_5O)_3SiCH_2N^+$ $(CH_3)_2C_{12}H_{25}$ $Cl^-$ | 4 |
| Siloxane dimer of $(C_2H_5O)_2(CH_3)SiCH_2N^+$ | 3 |

-continued

| | Grade |
|---|---|
| $(CH_3)_2C_{16}H_{33}$ $Cl^-$ | |
| Siloxane trimer of $(CH_3O)_3Si(CH_2)_3P^+$ $(CH_3)_2C_{12}H_{25}$ $Cl^-$ | 4 |
| Siloxane dimer of $(CH_3O)_3SiCH_2S^+$ $(CH_3)C_{12}H_{25}$ $Cl^-$ | 4 |

The addition of different water-soluble organic detergents as hereinbefore described to the solution at levels of 2:1 to 1:10,000 organosilane to detergent does not alter the relative grades of above. That is, such solutions still impart a noticeable soil release benefit to the glass slides. In particular, sodium 3-dodecylaminopropionate or 3-(N,N-dimethyl-N hexadecylammonio)-propane-1-sulfonate and the organosilane when tested as above give the same relative grades as above reported for the nonionic detergent.

The following examples are illustrative of detergent compositions containing the organosilanes of this invention. All impart a noticeable solid release benefit to metallic and vitreous surfaces washed or rinsed therewith.

| EXAMPLE II<br>Rinse aid | |
|---|---|
| $(CH_3O)_2C_{12}H_{25}SiCH_2N^+(CH_3)_2C_{10}H_{21}$ $Cl^-$ | 2.0% |
| Tallow alcohol ethoxylated with 9 moles of ethylene oxide | 15.0% |
| Water | balance |

when $(CH_3O)_2C_{12}H_{25}SICH_2P^+(CH_3)_2C_{10}H_{21}$ $Cl^-$ or $(CH_3O)_2C_{12}H_{25}SiCH_2S^+(CH_3)C_{10}H_{21}$ $Cl^-$ is substituted for the organosilane of Example II, substantially the same results are obtained.

| EXAMPLE III<br>Rinse Aid | |
|---|---|
| $(C_2H_5O)_3SiCH_2N^+(CH_3)_2C_{12}H_{25}$ $Cl^-$ | 5.0% |
| 50:50 mixture of $C_{14}$ and $C_{15}$ alcohols ethoxylated with 4 moles of ethylene oxide | 40.0% |
| Citric Acid | 8.0% |
| Water | balance |

Substantially the same results are obtained from the above composition when the organosilane is replaced by a similar compound having a phosphorous atom or a sulfur atom (and only one methyl group) in place of the nitrogen atom.

| EXAMPLE IV<br>Car Wash Detergent Composition | |
|---|---|
| $(CH_3O)_3Si(CH_2)_3N^+(CH_3)_2C_{18}H_{37}$ | 5.0% |
| Poly(oxyalkylene)nonionic detergent (Pluradot HA430 supplied by Wyandotte Corp.) | 26.0% |
| Magnesium Sulfate | 2.0% |
| Water | balance |

When the above organosilane is replaced with $(CH_3O)_3Si(CH_2)_3P^+(CH_3)_2C_{16}H_{37}\ Cl$ or $(CH_3O)_3Si(CH_2)_3S^+(CH_3)C_{16}H_{37}\ Cl^-$, substantially the same results are obtained.

EXAMPLE V
Light Duty Liquid Detergent Composition

| | |
|---|---|
| $(C_2H_5O)_3Si(CH_2)_3^+(CH_3)_2C_{16}H_{37}\ Cl^-$ | 0.05% |
| Nonyl phenol ethoxylated with 6 moles of ethylene oxide | 30.0 % |
| Water | balance |

EXAMPLE VI
Light Duty Liquid Detergent Composition

| | |
|---|---|
| $(C_3H_7O)_3Si(CH_2)_2N^+(C_2H_5)_2C_{10}H_{21}\ Br^-$ | 1.0% |
| Coconut alcohol ethoxylated with 6 moles of ethylene oxide | 25.0% |
| Potassium chloride | 2.0% |
| Sodium toluene sulfonate | 2.0% |
| Ethanol | 5.0% |
| Water | balance |

Replacement of the above organosilane with similar compounds having a phosphorous atom and a sulfur atom (and only one ethyl group) in place of the nitrogen atom gives substantially the same results.

EXAMPLE VII
Automatic Dishwashing Machine Detergent Composition

| | |
|---|---|
| $(C_2H_5O)_2C_8H_{17}SiCH_2N^+(CH_3)_2C_6H_{13}\ Cl^-$ | 1.0% |
| Tallow alcohol ethoxylated with 9 moles of ethylene oxide | 3.0% |
| Sodium Citrate | 50.0% |
| Sodium Sulfate | 43.0% |
| Misc. (water, perfume and dyes) | balance |

When $(C_2H_5O)_2C_8H_{17}SiCH_2P^+(CH_3)_2C_6H_{13}\ Cl^-$ or $(C_2H_5O)_2C_8H_{17}SiCH_2S^+(CH_3)C_6H_{13}\ Cl^-$ is substituted for the organosilane of Example VII, substantially the same results are obtained.

EXAMPLE VIII
Automatic Dishwashing Machine Detergent Composition

| | |
|---|---|
| $(CH_3O)_2CH_3Si(CH_2)_3N^+(C_2H_5)_2C_{16}H_{33}Cl^-$ | 0.05% |
| Sodium tripolyphosphate | 35.0% |
| Chlorinated trisodium phosphate | 21.0% |
| Poly(oxyalkylene) nonionic detergent (Pluradot HA433 supplied by Wyandotte Corp.) | 4.0% |
| Sodium silicate ($SiO_2$:$Na_2O$) | 17.5% |
| Sodium Sulfate | 21.0% |
| Miscellaneous (water, perfume, dyes, suds, suppressors, etc.) | Balance |

The use of similar organosilanes having a phosphorous or sulfur atom (and only one ethyl group) in place of the nitrogen atom results in satisfactory soil release benefits.

EXAMPLE IX
Commercial Automatic Dishwashing Detergent Composition

| | |
|---|---|
| $(C_4H_9O)_3SiCH_2N^+(CH_3)_2C_{10}H_{21}\ Cl^-$ | 2.0% |
| Tallow alcohol ethoxylated with 6 moles of ethylene oxide | 5.0% |
| Sodium tripolyphosphate | 50.0% |
| Sodium hydroxide | 15.0% |
| Sodium Sulfate | 25.0% |
| Misc. (water, perfume and dyes) | balance |

Substantially the same results are obtained from the above composition when the organosilane is replaced by a similar compound having a phosphorous atom or a sulfur atom (and only one methyl group) in place of the nitrogen atom.

EXAMPLE X
Commercial Automatic Dishwashing Detergent Composition

| | |
|---|---|
| $(C_4H_9O)_3SiCH_2N^+(CH_3)_2C_6H_{13}Cl^-$ | 0.5% |
| Sodium tripolyphosphate | 40.0% |
| Tallow alcohol ethoxylated with 9 moles of ethylene oxide | 3.0% |
| Sodium hydroxide | 22.0% |
| Sodium silicate | 10.0% |
| Chlorinated trisodium phosphate | 12.0% |
| Sodium sulfate | 10.0% |
| Miscellaneous (perfume, dyes, water) | Balance |

EXAMPLE XI
Window Cleaner

| | |
|---|---|
| $(C_2H_5O)_3Si(CH_2)_2N^+(C_3H_7)_2CH_2C_6H_5Cl^-$ | 0.01% |
| $C_{12}$ alcohol ethoxylated with 8 moles of ethylene oxide | 2.0% |
| Isopropanol | 97.99% |

The use of organosilane compounds having a phosphorous atom or a sulfur atom (and only one propyl group) in place of the nitrogen atom results in satisfactory products.

EXAMPLE XII
Abrasive Cleaner

| | |
|---|---|
| $(CH_3O)\ (CH_3)_2Si(CH_2)_3N^+(C_2H_5)_2C_{12}H_{25}\ Br^-$ | 1.0% |
| Coconut alcohol ethoxylated with 5 moles of ethylene oxide | 2.0% |
| Silica | 70.0% |
| Sodium sulfate | 23.0% |
| Miscellaneous (water, perfume, dyes) | Balance |

when $(CH_3O)\ (CH_3)_2Si(CH_2)_3P^+(C_2H_5)_2C_{12}H_{25}\ Br^-$ or $(CH_3O)\ (CH_3)_2Si(CH_2)_3S^+(C_2H_5)C_{12}H_{25}\ Br^-$ is substituted for the organosilane of Example XII, substantially the same results are obtained.

EXAMPLE XIII
In-Tank Toilet Bowl Cleaner

| | |
|---|---|
| $(CH_3O)_2SiCH_2N^+(CH_3)_2C_{10}H_{21}\ Cl^-$ | 0.5% |
| Sodium salt of sulfated coconut alcohol | 10.0% |

-continued

| EXAMPLE XIII<br>In-Tank Toilet Bowl Cleaner | |
|---|---|
| Sodium bisulfate | 1.0% |
| Ethanol | 5.0% |
| Water | balance |

Substitution of $$(CH_3O)_3SiCH_2P^+(CH_3)_2C_{10}H_{21}\ Cl^-$$

or $$(CH_3O)_3SiCH_2S^+(CH_3)C_{10}H_{21}\ Cl^-$$

for the above organosilane gives substantially the same results.

| EXAMPLE XIV<br>Light Duty Liquid Detergent Composition | |
|---|---|
| $(C_2H_5O)_3Si(CH_2)_3N^+(CH_3)_2C_{18}H_{37}\ Cl^-$ | 1.0% |
| Coconut alcohol ethoxylated with 6 moles of ethylene oxide | 22.0% |
| Dimethyldodecylamine oxide | 12.0% |
| Ethanol | 5.4% |
| Water | balance |

Satisfactory results are obtained when the organosilanes of Examples II – XIV are replaced by any of the organosilanes of Example I. Siloxane oligomers of the organosilanes of Examples I – XIV having a degree of polymerization of from 2 to 100 when substituted in the above examples for the organosilane monomer also give a noticeable soil release benefit to surface washed or rinsed therewith.

The compositions of this invention are generally diluted with water during usage. Under normal usage conditions, from 0.2 to 20 p.p.m. of organosilane is found in the wash or rinse solution. Surprisingly, even from such a low concentration, the organosilane molecule of this invention deposits itself upon hard surfaces in an amount sufficient to provide a noticeable soil release benefit. As previously discussed, it is believed the positively charged atom in the molecule is largely responsible for the necessary deposition to take place under such dilute conditions.

In another aspect of this invention, the organosilane is used in a commercial dishwashing machine as part of the final rinse cycle and free of any organic detergent. Thus, the organosilane is metered into the rinse water at a level sufficient to provide a soil release benefit (i.e. about 0.2 to 20 p.p.m. organosilane) and applied to the previously washed cooking utensils and tableware.

What is claimed is:

1. A detergent composition capable of imparting soil release benefits to metallic and vitreous surfaces contacted therewith consisting essentially of;

a. an organosilane having the formula

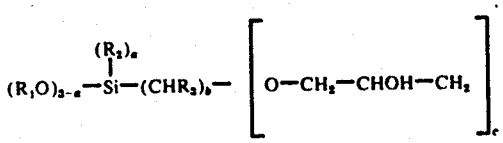

-continued

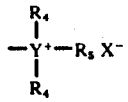

or is a siloxane oligomer thereof wherein $R_1$ is an alkyl group containing 1 to 4 carbon atoms, $$(CH_3)_3Si \text{ or } Z(OCH_xH_{2x})_m$$

where $x$ is 2 to 4, $m$ is 1 to 20, and Z is hydrogen, an alkyl group containing 1 to 18 carbons or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that there is no $X^-$ when $R_4$ is oxygen; $R_5$ is an alkyl, aryl or arylalkyl group containing 1 to 22 carbon atoms; X is halide; and Y is nitrogen, sulfur or phosphorus; and b. a water-soluble organic detergent selected from the group consisting of nonionic, zwitterionic and ampholytic detergents and mixtures thereof in a weight ratio of organosilane to detergent of from 2:1 to 1:10,000.

2. The composition of claim 1 wherein the organosilane has the formula

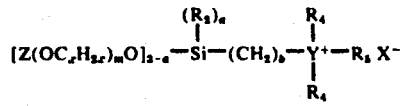

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

3. The composition of claim 1 wherein the organosilane has the formula

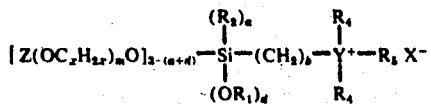

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms, $a$ is 0 or 1; $d$ is 1 or 2 provided $a+d$ does not exceed 2; $b$ is 1 to 3; $R_4$ is an alkyl, aryl or arylalkyl group containing 1 to 12 carbon atoms, a carboxy-substituted alkyl group containing 1 to 4 carbon atoms.

$$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

4. The composition of claim 1 wherein the organosilane has the formula $$[Z(OC_xH_{2x})_mO]_{3-a}-\overset{(R_2)_a}{\underset{}{Si}}-CHR_3-\overset{R_4}{\underset{R_4}{Y^+}}-R_5\ X^-$$

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $R_3$ is an alkyl group containing 1 to 18 carbon atoms; $R_4$ is an alkyl, aryl or arylalkyl group containing 1 to 12 carbon atoms, a carboxy-substituted alkyl group containing 1 to 4 carbon atoms.

$$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

5. The composition of claim 1 wherein the organosilane has the formula $$[Z(OC_xH_{2x})_mO]_{3-(a+d)}-\underset{(OR_1)_d}{\overset{(R_2)_a}{Si}}-CHR_3-\overset{R_4}{\underset{R_4}{Y^+}}-R_5\ X^-$$

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided $a+d$ does not exceed 2; $R_3$ is an alkyl group containing 1 to 18 carbon atoms; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

6. The composition of claim 1 wherein the or organosilane has the formula $$[(CH_3)_3-Si-O]_{3-a}-\overset{(R_2)_a}{Si}-(CH_2)_b-\overset{R_4}{\underset{R_4}{Y^+}}-R_5\ X^-$$

or is a siloxane oligomer thereof wherein $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

7. The composition of claim 1 wherein the organosilane has the formula $$[(CH_3)_3-Si-O]_{3-a}-\overset{(R_2)_a}{Si}-CHR_3-\overset{R_4}{\underset{R_4}{Y^+}}-R_5\ X^-$$

or is a siloxane oligomer thereof wherein $R_2$ is an alkyl group containing 1 to 18 carbon atoms; $a$ is 0 to 2; $R_3$ is an alkyl group containing 1 to 18 carbon atoms; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

8. The composition of claim 1 wherein the organosilane has the formula $$[Z(OC_xH_{2x})_mO]_{3-a}-\overset{(R_2)_a}{Si}-(CH_2)_b-O-CH_2-CHOH-CH_2-\overset{R_4}{\underset{R_4}{Y^+}}-R_5\ X^-$$

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

9. The composition of claim 1 wherein the organosilane has the formula $$[Z(OC_xH_{2x})_mO]_{3-(a+d)}-\underset{(OR_1)_d}{\overset{(R_2)_a}{Si}}-(CH_2)_b-O-CH_2-CHOH-CH_2-\underset{R_4}{\overset{R_4}{Y^+}}-R_5\ X^-$$

or is a siloxane oligomer thereof wherein Z is hydrogen, an alkyl group containing 1 to 18 carbon atoms or an acyl group containing 1 to 4 carbon atoms, $x$ is 2 to 4, and $m$ is 1 to 20; $R_2$ is an alkyl group containing 1 to 18 carbon atoms; $R_1$ is an alkyl group containing 1 to 4 carbon atoms; $a$ is 0 or 1; $d$ is 1 or 2 provided $a+d$ does not exceed 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

10. The composition of claim 1 wherein the organosilane has the formula $$[(CH_3)_3Si-O]_{3-a}-\overset{(R_2)_a}{Si}-(CH_2)_b-O-CH_2-CHOH-CH_2-\underset{R_4}{\overset{R_4}{Y^+}}-R_5\ X^-$$

or is a siloxane oligomer thereof wherein $R_2$ is an alkyl group containing 1 to 18 carbon atoms; $a$ is 0 to 2; $b$ is 1 to 3; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$ is 2 to 4, $m$ is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

11. The composition of claim 1 in which said organosilane has the formula $$(R_1O)_{3-a}-\overset{(R_2)_a}{Si}-(CHR_3)_b-\left[O-CH_2-CHOH-CH_2\right]_c-\underset{R_4}{\overset{R_4}{N^+}}-R_5\ X^-$$

or is a siloxane oligomer thereof wherein $R_1$ is an alkyl group containing 1 to 4 carbon atoms, $$(CH_3)_3Si \text{ or } Z(OC_xH_{2x})_m$$

where $x$ is 2 to 4, $m$ is 1 to 20, and Z is hydrogen, an alkyl group containing 1 to 18 carbons or an acyl group containing 1 to 4 carbon atoms; $R_2$ is an alkyl group containing 1 to 18 carbon atoms; $a$ is 0 to 2; $R_3$ is hydrogen or an alkyl group containing 1 to 18 carbon atoms; $b$ is 1 to 3; $c$ is 0 or 1; $R_4$ is an alkyl, aryl or arylalkyl group containing 1 to 12 carbon atoms, a carboxy-substituted alkyl group containing 1 to 4 carbon atoms, $$(C_xH_{2x}O)_mZ$$

where $x$, $m$ and Z are as defined above, or oxygen provided only one $R_4$ is oxygen and further provided than when $R_4$ is oxygen there is no $X^-$; $R_5$ is an alkyl, aryl or arylalkyl group containing 1 to 2 carbon atoms; and X is halide.

12. The composition of claim 1 wherein the organosilane has the formula $$(R_1O)_3-Si-(CH_2)_b-\underset{R_4}{\overset{R_4}{Y^+}}-R_5\ X^-$$

or is a siloxane oligomer thereof wherein $R_1$ is an alkyl group containing 1 to 4 carbon atoms; $b$ is 1 to 3; $R_4$ is an alkyl, aryl or arylalkyl group containing 1 to 12 carbon atoms, a carboxy-substituted alkyl group containing 1 to 4 carbon toms, $$(C_xH_{2x}O)_mZ$$

where $x$ is 2 to 4, $m$ is 1 to 20, and Z is hydrogen, and alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 4 to 22 carbon atoms; X is a halide; and Y is nitrogen, sulfur or phosphorus.

13. The composition of claim 1 wherein the organosilane has the formula

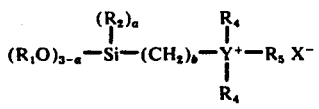

or is a siloxane oligomer thereof wherein $R_1$ is an alkyl group containing 1 to 4 carbon atoms; $R_2$ is an alkyl group containing 1 to 18 carbon atoms, *a* is 1 or 2; *b* is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorus.

14. The composition of claim 1 wherein the organosilane has the formula

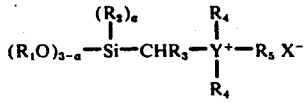

or is a siloxane oligomer thereof wherein $R_1$ is an alkyl group containing 1 to 4 carbon atoms; $R_2$ is an alkyl group containing 1 to 18 carbon atoms; *a* is 0 to 2; $R_3$ is an alkyl group containing 1 to 18 carbon atoms; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2 to 4, *m* is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atms; X is a halide; and Y is nitrogen, sulfur or phosphorus.

15. The composition of claim 1 wherein the organosilane has the formula

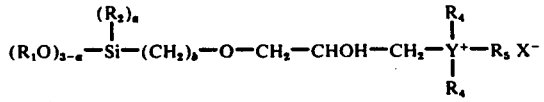

or is a siloxane oligomer thereof wherein $R_1$ is an alkyl group containing 1 to 4 carbon atoms; $R_2$ is an alkyl group containing 1 to 18 carbon atoms; *a* is 0 to 2; *b* is 1 to 3; $R_4$ is an alkyl, aryl or arylalkyl group containing 1 to 12 carbon atoms, a carboxy-substituted alkyl group containing 1 to 4 carbon atoms, $(C_xH_{2x}O)_mZ$ where *x* is 2to 4, *m* is 1 to 20, and Z is hydrogen, an alkyl group containing 1 to 18 carbon atoms or an acyl group containing 1 to 4 carbon atoms, or oxygen provided only one $R_4$ is oxygen and further provided that when $R_4$ is oxygen there is no $X^-$; $R_5$ is an alkyl, aryl or arylalkyl group containing 1 to 22 carbon atoms; X is halide; and Y is nitrogen, sulfur or phosphorous.

16. The composition of claim 1 wherein *b* is 1 and X is chloride or bromide.

17. The composition of claim 1 wherein the oligomer has a degree of polyermization of 2 to 100.

18. The composition of claim 1 wherein the ratio of organosilane to detergent is from 1:1 to 1:500.

19. The composition of claim 17 intended for use as a light-duty liquid detergent composition consisting essentially of:

a. from 0.01% to 10% of the organosilane;
b. from 10% to 90% of the water-soluble organic detergent; and
c. the balance water.

20. The composition of claim 1 intended for use as a rinse aid consisting essentially of:

a. from 0.1% to 50% of the organosilane;
b. from 5% to 99.9% of a water-soluble nonionic detergent; and
c. the balance water.

21. The composition of claim 1 intended for use in an automatic dishwashing machine consisting essentially of:

a. from 0.01% to 5% of the organosilane;
b. from 0.1% to 15% of the water-soluble nonionic detergent;
c. from 5% to 60% of a water-soluble organic or inorganic alkaline builder salt; and
d. the balance inert filler salts.

22. The composition of claim 1 intended for use in a commercial automatic dishwashing machine consisting essentially of:

a. from 0.1 to 5% of the organosilane;
b. from 0.1% to 15% of the water-soluble nonionic detergent;
c. from 5% to 60% of a water-soluble organic or inorganic alkaline builder salt;
d. from 10% to 40% of an alkali metal base; and
e. the balance inert filler salts.

23. The composition of claim 1 intended for use as a window cleaner consisting essentially of:

a. from 0.001% to 5% of the organosilane;
b. from 0.1% to 5% of the water-soluble organic detergent; and
c. the balance an inert organic solvent.

24. The composition of claim 1 intended for use as an abrasive cleaner consisting essentially of:

a. from 0.002% to 5% of the organosilane;
b. from 0.01% to 10% of the water-soluble organic detergent; and
c. from 50% to 95% of a water-insoluble abrasive; and
d. the balance inert filler salts.

25. The composition of claim 1 intended for use as a car wash detergent composition consisting essentially of:
a. from 0.01% to 10% of the organosilane;
b. from 20% to 35% of the water-soluble organic detergent; and
c. the balance water.

26. The composition of claim 1 intended for use as intank toilet bowl cleaner consisting essentially of:
a. from 0.01% to 10% of the organosilane;
b. from 0.5% to 20% of the water-soluble organic detergent;
c. from 0.1% to 5% of sodium bisulfate;
d. from 0.1% to 20% of a lower alcohol; and
e. the balance water.

27. The method of imparting soil release benefits to cooking utensils and tableware comprising rinsing the cooking utensils and tableware with a water solution containing the organosilane of claim 1.

28. The composition of claim 1 wherein the organosilane has the formula

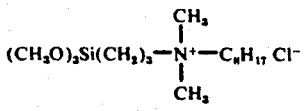

29.. The composition of claim 17 wherein the oligomer has a degree of polymerization of 2 to 20.

30. The composition of claim 18 wherein the ratio of organosilane to detergent is from 1:3 to 1:60.

31. The composition of claim 19 consisting essentially of:
a. from 0.1% to 2% of the organosilane
b. from 20% to 40% of the water-soluble organic detergent;
c. from 0.5% to 5% of an electrolyte; and
d. the balance water.

32. The composition of claim 20 consisting essentially of:
a. from 1% to 10% of the organosilane;
b. from 10% to 50% of the water-soluble nonionic detergent;
c. from 1% to 30% of a sequestering agent; and
d. the balance water.

33. The composition of claim 21 wherein the composition additionally contains from 7% to 35% of an alkali metal silicate having a $SiO_2$:$M_2O$ ratio of from 3.6:1 to 1:2 wherein M is an alkali metal.

34. The composition of claim 22 consisting essentially of:
a. from 0.1% to 2% of the organosilane;
b. from 1% to 5% of the water-soluble nonionic detergent;
c. from 30% to 50% of the organic or inorganic alkaline builder salt;
d. from 10% to 30% of the alkali metal base; and
e. the balance inert filler salts.

35. The composition of claim 23 consisting essentially of:
a. from 0.002% to 1% of the organosilane;
b. from 0.5% to 3% of the water-soluble organic detergent; and
c. the balance the inert organic solvent.

36. The composition of claim 24 consisting essentially of:
a. from 0.01% to 1% of the organosilane;
b. from 1% to 5% of the water-soluble organic detergent;
c. from 50% to 75% of the water-insoluble abrasive; and
d. the balance inert filler salts.

37. The composition of claim 25 additionally containing from 1% to 10% magnesium sulfate.

38. The composition of claim 31 additionally containing from 1% to 20% of a hydrotrope and from 1% to 20% of a lower alcohol.

39. The composition of claim 23 wherein the composition additionally contains sufficient bleach to give the product an available chlorine content of from 0.5% to 10%.

40. The composition of claim 34 additionally containing from 7% to 35% of an alkali metal silicate having a $SiO_2$:$M_2O$ ratio of from 3.6:1 to 1:2 wherein M is an alkali metal and sufficient bleach to give the product an available chlorine content of from 0.5% to 10%.

41. The composition of claim 39 consisting essentially of:
a. from 0.1% to 2% of the organosilane;
b. from 1% to 5% of the water-soluble nonionic detergent;
c. from 30% to 50% of the water-soluble organic or inorganic alkaline builder salt;
d. from 10% to 20% of the alkali metal silicate;
e. sufficient bleach to give the product an available chlorine content of from 1% to 5%; and
f. the balance inert filler salts.

42. The composition of claim 41 wherein the inorganic alkaline builder salt is sodium tripolyphosphate.

43. The composition of claim 42 wherein the bleach is chlorinated trisodium phosphate.

44. The composition of claim 43 wherein the inert filler salt is sodium sulfate or sodium chloride.

45. The composition of claim 44 wherein the organosilane has the formula

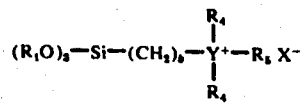

wherein $R_1$ is an alkyl group containing 1 to 4 carbon atoms, *b* is 1 to 3, $R_4$ is an alkyl, aryl or arylalkyl group containing 1 to 12 carbon atoms, $R_5$ is an alkyl group containing 4 to 22 carbon atoms, X is halide and Y is nitrogen.

* * * * *

UNITED STATES PATENT OFFICE

CERTIFICATE OF CORRECTION

PATENT NO. : 4,005,028
DATED : Jan. 25, 1977
INVENTOR(S) : David C. Heckert; David M. Watt, Jr.

It is certified that error appears in the above-identified patent and that said Letters Patent are hereby corrected as shown below:

Column 1, line 40, after "has" insert -- now --.

Column 5, line 59, "$(C_2H_5O)_3Si(CH_2)_2P^+(C_3H_6COOH)C_2H_5)C_{10}H_{21}$ $Cl^-$" should be -- $(C_2H_5O)_3Si(CH_2)_2P^+(C_3H_6COOH)(C_2H_5)C_{10}H_{21}Cl^-$ --.

Column 5, line 66, "$(C_2H_5O)_3si(CH_2)_2S^+(O)^-C_{10}H_{21}$" should be -- $(C_2H_5O)_3Si(CH_2)_2S^+(O)^-C_{10}H_{21}$ --.

Column 8, line 31, "$(CH_3O)_3SiCH(C_8H_{17})P^+CH_3)_3$ $Cl^-$" should be -- $(CH_3O)_3SiCH(C_8H_{17})P^+(CH_3)_3Cl^-$ --.

Column 8, line 58, "$(C_2H_5O)_3SiCH(C_6H_{13})P^+[(C_3H_6O)_2C_{18}H_{37}](CH_32)_2$" should be -- $(C_2H_5O)_3SiCH(C_6H_{13})P^+[(C_3H_6O)_2C_{18}H_{37}](CH_3)_2$ --.

Column 9, line 63, "$H_4O)C_{14}H_{29}[C_6H_4CH_3$ $Cl^-$" should be -- $H_4O)C_{14}H_{29}]C_6H_4CH_3$ $Cl^-$ --.

Column 12, line 11, "$[H(OC_3H_6)_4O]_3SiCH(C_{14}H_{29})S^-(C_4H_8OH)C_6H_5$ $Cl^-$" should be -- $[H(OC_3H_6)_4O]_3SiCH(C_{14}H_{29})S^+(C_4H_8OH)C_6H_5$ $Cl^-$ --.

Column 12, line 59, "$[H(OC_2H_6)_6O](C_2H_5O)_2SiCH_{12}H_{25}N^+[(C_2$" should be -- $[H(OC_2H_6)_6O](C_2H_5O)_2SiCHC_{12}H_{25}N^+[(C_2$ --.

Column 14, line 44, "$[(CH_3)_3SiO]_3SiCH(C_2H_5)N^+](C_2H_4O)_6COCH_3]_2CH_3$" should be -- $[(CH_3)_3SiO]_3SiCH(C_2H_5N^+[(C_2H_4O)_6COCH_3]_2CH_3$ --.

UNITED STATES PATENT OFFICE
CERTIFICATE OF CORRECTION

PATENT NO. : 4,005,028
DATED : Jan. 25, 1977
INVENTOR(S) : David C. Heckert; David M. Watt, Jr.

It is certified that error appears in the above-identified patent and that said Letters Patent are hereby corrected as shown below:

Column 17, line 66, "$[Z(OC_xH_{2x}O)_mO]_{3-(a+d)}-Si-(CH_2)_b-O-CH_2-CHOH-CH_2-Y^+-R_5X^-$" should be -- $[Z(OC_xH_{2x})_mO]_{3-(a+d)}-Si-(CH_2)_b-O-CH_2-CHOH-CH_2-Y^+-R_5X^-$ --.

Column 18, line 20, "$[H(OC_3H_6O)_3O](C_2H_5)(CH_3Si(CH_2)_2OCH_2$" should be -- $[H(OC_3H_6O](C_2H_5O)(CH_3Si(CH_2)_2OCH_2$ --.

Column 18, line 30, "$[H(OC_2H_4)_8O](C_2H_5)_2SiCH_2OCH_2$" should be -- $[H(OC_2H_4)_8O](C_2H_5O)_2SiCH_2OCH_2$ --.

Column 18, line 44, "1975 of" should be -- 1975, discloses the preparation of --.

Column 19, line 41, "$H_6O)_8C_2H_5](C_4H_9)_2\ Cl^-$" should be -- $H_6O)_8C_2H_5](C_4H_9)_2\ Cl^-$ --.

Column 19, line 51, "$H_4O)_6H)]C_6H_4CH_3\ Cl^-$" should be -- $H_4O)_6H]C_6H_4CH_3\ Cl^-$ --.

Column 20, line 13, "abovedescribed" should be -- above described --.

Column 25, line 11, "$(C_2H_5O)_3Si(CH_2)_3^+(CH_3)_2C_{18}H_{37}\ Cl^-$" should be -- $(C_2H_5O)_3Si(CH_2)_3N^+(CH_3)_2C_{18}H_{37}\ Cl^-$ --.

UNITED STATES PATENT OFFICE
CERTIFICATE OF CORRECTION

PATENT NO. : 4,005,028
DATED : Jan. 25, 1977
INVENTOR(S) : David C. Heckert; David M. Watt, Jr.

It is certified that error appears in the above-identified patent and that said Letters Patent are hereby corrected as shown below:

Column 25, line 55, "$(CH_3O)_2CH_3Si(CH_2)_2N^+(C_2H_5)_2C_{16}H_{33}Cl^-$ 0.05%" should be -- $(CH_3O)_2CH_3Si(CH_2)_2N^+(C_2H_5)_2C_{16}H_{33}Cl^-$ 0.5% --.

Column 27, line 36, "surface" should be -- surfaces --.

Column 32, line 60, "toms" should be -- atoms --.

Column 32, line 64, "hydrogen and" should be -- hydrogen an --.

Column 33, line 49, "atms" should be -- atoms --.

Column 34, line 7, "is halide" should be -- is a halide --.

Column 34, line 14, "claim 17" should be -- claim 1 --.

Column 36, line 20, "claim 23" should be -- claim 33 --.

Signed and Sealed this

*ninth* Day of *August 1977*

[SEAL]

*Attest:*

RUTH C. MASON
*Attesting Officer*

C. MARSHALL DANN
*Commissioner of Patents and Trademarks*